US009595432B2

(12) United States Patent
Giles et al.

(10) Patent No.: US 9,595,432 B2
(45) Date of Patent: Mar. 14, 2017

(54) TIME-OF-FLIGHT MASS SPECTROMETER AND A METHOD OF ANALYSING IONS IN A TIME-OF-FLIGHT MASS SPECTROMETER

(75) Inventors: Roger Giles, Holmfirth (GB); Michael Sudakov, St. Petersburg (RU); Hermann Wollnik, Santa Fe, NM (US)

(73) Assignee: SHIMADZU CORPORATION, Nakagyo-Ku, Kyoto (JP)

( * ) Notice: Subject to any disclaimer, the term of this patent is extended or adjusted under 35 U.S.C. 154(b) by 1188 days.

(21) Appl. No.: 12/518,236

(22) PCT Filed: Dec. 7, 2007

(86) PCT No.: PCT/GB2007/004689

§ 371 (c)(1),
(2), (4) Date: Dec. 2, 2009

(87) PCT Pub. No.: WO2008/071923

PCT Pub. Date: Jun. 19, 2008

(65) Prior Publication Data

US 2010/0072362 A1 Mar. 25, 2010

(30) Foreign Application Priority Data

Dec. 11, 2006 (GB) ..... 0624679.7

(51) Int. Cl.
*H01J 49/00* (2006.01)
*H01J 49/40* (2006.01)
*H01J 49/42* (2006.01)

(52) U.S. Cl.
CPC ..... *H01J 49/403* (2013.01); *H01J 49/4295* (2013.01)

(58) Field of Classification Search
None
See application file for complete search history.

(56) References Cited

U.S. PATENT DOCUMENTS 5,179,278 A 1/1993 Douglas
5,248,875 A 9/1993 Douglas et al.
(Continued)

FOREIGN PATENT DOCUMENTS

GB 2-299-446 11/1998
GB 2-389-452 A 12/2003
(Continued)

OTHER PUBLICATIONS

European Patent Office, International Search Report, Nov. 14, 2008, for International Application No. PCT/GB2007/004689.
(Continued)

*Primary Examiner* — Andrew Smyth
(74) *Attorney, Agent, or Firm* — Stephen J. Weyer, Esq.; Nicholas Trenkle; Stites & Harbison, PLLC.

(57) ABSTRACT

A time-of-flight mass spectrometer (1) comprises an ion source a segmented linear ion device (10) for receiving sample ions supplied by the ion source and a time-of-flight mass analyzer for analyzing ions ejected from the segmented device. A trapping voltage is applied to the segmented device to trap ions initially into a group of two or more adjacent segments and subsequently to trap them in a region of the segmented device shorter than the group of segments. The trapping voltage may also be effective to provide a uniform trapping field along the length of the device (10).

77 Claims, 27 Drawing Sheets

(56) References Cited

U.S. PATENT DOCUMENTS 5,572,022 A * 11/1996 Schwartz ..... H01J 49/4265 250/282
5,576,540 A 11/1996 Jolliffe
5,763,878 A 6/1998 Franzen
6,020,586 A 2/2000 Dresch et al.
6,049,077 A 4/2000 Franzen
6,075,244 A 6/2000 Baba et al.
6,111,250 A 8/2000 Thomson et al.
6,441,370 B1 8/2002 Khosla et al.
6,465,777 B1 10/2002 Rache
6,483,109 B1 * 11/2002 Reinhold ..... H01J 49/004 250/282
6,545,268 B1 4/2003 Verentchikov et al.
6,570,152 B1 5/2003 Hoyes
6,627,876 B2 9/2003 Hager
6,683,301 B2 1/2004 Whitehouse et al.
6,700,118 B2 3/2004 Yefchak et al.
6,717,132 B2 4/2004 Franzen
6,720,554 B2 4/2004 Hager
6,727,495 B2 * 4/2004 Li ..... G01N 27/622 250/281
6,753,523 B1 6/2004 Whitehouse et al.
6,770,871 B1 8/2004 Wang et al.
6,797,950 B2 9/2004 Schwartz et al.
6,800,846 B2 10/2004 Bateman et al.
6,858,840 B2 2/2005 Berkout et al.
6,872,938 B2 3/2005 Makarov et al.
6,897,438 B2 * 5/2005 Soudakov ..... H01J 49/4225 250/282
6,965,106 B2 * 11/2005 Ding ..... H01J 49/424 250/282
6,977,371 B2 12/2005 Bateman et al.
6,987,261 B2 1/2006 Horning et al.
6,995,364 B2 2/2006 Makarov et al.
6,995,366 B2 2/2006 Franzen
6,998,609 B2 2/2006 Makarov et al.
7,019,285 B2 3/2006 Dresch et al.
7,034,292 B1 4/2006 Whitehouse et al.
7,034,293 B2 * 4/2006 Wells ..... H01J 49/423 250/292
7,047,144 B2 5/2006 Steiner
7,095,013 B2 8/2006 Bateman et al.
7,166,836 B1 1/2007 Russ et al.
7,189,967 B1 3/2007 Whitehouse et al.
7,193,207 B1 3/2007 Ding et al.
7,227,138 B2 6/2007 Lee et al.
7,265,344 B2 9/2007 Makarov et al.
7,312,441 B2 12/2007 Land et al.
7,312,442 B2 12/2007 Hansen
7,326,925 B2 2/2008 Verentchikov et al.
7,348,554 B2 3/2008 Hashimoto et al.
7,351,965 B2 * 4/2008 Wells ..... H01J 49/423 250/281
7,378,653 B2 * 5/2008 Wells ..... H01J 49/005 250/281
7,385,187 B2 6/2008 Verentchikov et al.
7,405,399 B2 * 7/2008 Wells ..... H01J 49/4225 250/281
7,405,400 B2 * 7/2008 Wells ..... H01J 49/423 250/281
7,425,699 B2 9/2008 Makarov et al.
7,449,686 B2 11/2008 Wang et al.
7,456,396 B2 11/2008 Quarmby et al.
7,476,850 B2 1/2009 Oonishi et al.
7,498,569 B2 3/2009 Ding
7,501,623 B2 * 3/2009 Tong ..... H01J 49/4225 250/282
7,598,488 B2 * 10/2009 Park ..... H01J 49/004 250/282
2002/0125421 A1 9/2002 Yoshinari et al.
2003/0066958 A1 * 4/2003 Okumura ..... H01J 49/401 250/286
2003/0132379 A1 * 7/2003 Li ..... G01N 27/622 250/286
2003/0141447 A1 * 7/2003 Verentchikov ..... H01J 49/004 250/287
2003/0173524 A1 * 9/2003 Syka ..... H01J 49/022 250/292
2004/0195504 A1 * 10/2004 Senko ..... H01J 49/4225 250/291
2004/0217272 A1 * 11/2004 Horning ..... H01J 49/4265 250/282
2004/0245448 A1 * 12/2004 Glish ..... H01J 49/0054 250/281
2004/0262511 A1 * 12/2004 Kato ..... H01J 49/0095 250/281
2005/0017167 A1 * 1/2005 Franzen ..... H01J 49/4225 250/288
2005/0258364 A1 11/2005 Whitehouse et al.
2005/0263696 A1 * 12/2005 Wells ..... H01J 49/423 250/292
2007/0057173 A1 * 3/2007 Kovtoun ..... H01J 49/164 250/281
2007/0084998 A1 4/2007 Franzen et al.
2007/0158550 A1 * 7/2007 Wells ..... H01J 49/4225 250/292
2007/0176094 A1 * 8/2007 Wells ..... H01J 49/4225 250/292
2007/0176095 A1 * 8/2007 Tong ..... H01J 49/423 250/292
2007/0176096 A1 * 8/2007 Wells ..... H01J 49/423 250/292
2007/0176097 A1 * 8/2007 Wells ..... H01J 49/4255 250/292
2007/0176098 A1 * 8/2007 Wells ..... H01J 49/423 250/292
2007/0203652 A1 * 8/2007 Horning ..... H01J 49/38 702/19
2007/0273385 A1 11/2007 Makarov et al.
2008/0035842 A1 2/2008 Sudakov et al.
2008/0054173 A1 3/2008 Yasuda et al.
2008/0087810 A1 4/2008 Gabeler
2008/0091370 A1 4/2008 Gabeler
2011/0095175 A1 * 4/2011 Bateman ..... G01N 27/624 250/282

FOREIGN PATENT DOCUMENTS

GB 2-404-784 6/2005
GB 2-418-775 A 4/2006
JP 2002-260575 9/2002
JP 2006-093160 4/2006
WO WO2006/103412 A2 10/2006
WO WO2006/103445 A2 10/2006
WO WO2006/103448 A2 10/2006
WO WO2007/027764 A2 3/2007
WO WO2007/044696 4/2007

OTHER PUBLICATIONS

UK Intellectual Property Office, Search Report, Jun. 26, 2007, for GB0624679.7.
UK Intellectual Property Office, Search Report, Aug. 30, 2007, for GB0624679.7.
Ishihara, Morio, et al, "Construction of a New Compact Multi-turn Time-of-Flight Mass Spectrometer 'MULTUM II'", 2000, 48th Annual Conference on Mass Spectrometry, Conference Proceedings, pp. 316-317, Mass Spectrometry Society of Japan, Nagoya, Japan (English Translation).
Office Action for Japanese Application No. 2009-286573, Oct. 29, 2013, Japanese Patent Office.
European Search Report—Application No. EP 14 16 9423, dated Jan. 27, 2015 with the Extended European Search Report, 8 pages.
R. Grix, et al., "An Electron Impact Storage Ion Source for Time-of-Flight Mass Spectrometers", 1989, pp. 323-330, vol. 93, International Journal of Mass Spectrometry and Ion Processes, Elsevier Science Publishers B.V., Amsterdam.

* cited by examiner

TIME-OF-FLIGHT MASS SPECTROMETER AND A METHOD OF ANALYSING IONS IN A TIME-OF-FLIGHT MASS SPECTROMETER

FIELD OF THE INVENTION

This invention relates to a time-of-flight (ToF) mass spectrometer and a method of analysing ions in a ToF mass spectrometer. In particular, the invention relates to a ToF mass spectrometer having a segmented linear ion storage device.

ToF mass spectrometers, including quadrupole mass filter-ToF mass spectrometers and quadrupole ion trap ToF mass spectrometers are now commonly employed in the field of mass spectrometry. Commercially available ToF instruments offer resolving power of up to ~20 k and a maximum mass accuracy of 3 to 5 ppm. By comparison, FTICR (Fourier Transform Ion Cyclotron Resonance) instruments can achieve a much higher resolving power of at least 100 k. The primary advantage of such high resolution is improved accuracy of mass measurement. This is necessary to confidently identify the analysed compounds.

However, despite their very high resolving power, FTICR instruments have a number of disadvantages in comparison to ToF instruments. Firstly, the number of spectra that can be recorded per second is low, and secondly at least 100 ions are necessary to register a spectral peak of reasonable intensity. These two disadvantages mean that the limit of detection is compromised. A third disadvantage of FTICR instruments is that a superconducting magnet is required. This means that the instrument is bulky, and has associated high purchase costs and high running costs. Therefore, there is a strong incentive to improve the resolving power offered by ToF mass spectrometers.

High resolving power during the isolation of precursor ions is important for the generation of isotopically pure MS/MS daughter ion spectra, and for the elimination of isobaric interference ions. A low detection limit is important, in the field of proteomics for example, to allow for the detection of weakly expressed protein(s) in the presence of more abundant proteins, and in many other applications areas for detecting samples at low concentration.

The capability to produce a large number of spectra per second is needed when samples are provided by Liquid Chromatography (LC) where the individually separated compounds are delivered to the mass spectrometer in short bursts or bunches lasting only a few seconds. To obtain maximum information about each compound as it elutes from the LC column, it is necessary to generate high quality spectra at a high rate. In the case where samples are directly infused without chromotographic separation, it is also useful to have the capability to generate a high number of spectra to reduce the overall analysis time, providing improved productivity.

It is desirable to achieve a high dynamic range within each acquired spectrum, so that the spectrum provides high fidelity data (good statistics and high signal-to-noise ratio), making it unnecessary to accumulate equivalent spectra. Avoiding the need for such accumulation is equivalent to increasing the effective repetition rate, and again enhances productivity.

A large mass range, (the ratio between the highest and lowest detectable masses) is also advantageous for the following reasons:

To achieve highest mass accuracy it is necessary for the spectra to contain at least one internal calibration peak. A large mass range enables the unknown peaks to lie within a corresponding wider mass range without the need for a custom calibrant for each analyte.

A second advantage of a 'single shot' wide mass range capability is in the MS/MS analysis of peptides; peptide ions fragment such that only the bonds between adjacent amino acids in the peptide chain are broken. A series of peaks are generated which enable the amino acid sequence of the peptide to be identified. These peaks may have a wide distribution of m/z values, and as the probability of a unique identification of the protein is dependent upon the number of detected peaks it is advantageous to have a wide mass range available.

The basic behaviour of ions in an ion trap can be described by the Mathieu parameters a and q. If the Mathieu parameter q is <0.4 then the ion motion can be viewed as secular motion within a harmonic 'pseudopotential well' whose depth is proportional to the product of the amplitude of the trapping waveform and the Mathieu parameter q. If a buffer gas is present in the ion trap then after a short cooling period the trapped ions will lose their kinetic energy to the buffer gas and come to reside at the centre of the pseudopotential well (in the region of lowest potential).

This localisation due to cooling results in an ion cloud occupying a reduced area in "velocity-position" phase space. More specifically, the ion cloud has reduced physical size and reduced velocity spread in directions transverse to the longitudinal axis of the ion trap. Thus, the ion cloud has a reduced emittance when it is ejected from the ion trap, and this can be of benefit to the performance of an associated ToF analyser. In particular, the root mean squared velocity (RMSV) $v_{th}(M)$ of an equilibrated ion cloud consisting of ions of mass M is given by the expression:

$$v_{th}(M) := \sqrt{\frac{K_b \cdot T}{M \cdot m_o}}, \tag{1}$$

where $K_b$ is Boltzman constant, $m_o$ is the unit mass and the temperature T of the ion cloud is determined by the temperature of the buffer gas, and 'Turn around time', $\Delta T_{turn_around}$ of ions ejected from the ion trap is related to RMSV by the expression.

$$\Delta T_{turn_around} := \frac{2M}{E_o \cdot \gamma} v_{th}(M), \tag{2}$$

when γ is the ratio of the unit mass value to unit change value and is $9.97997 \times 10^7$.

Thus an ion cloud having a reduced RMSV, will also have a reduced $\Delta T_{turn_around}$ and this results in improved resolving power, because $\Delta T_{turn_around}$ sets a limit for the mass resolving power of most types of ToF analysers.

More specifically, the resolving power of a ToF analyser is given by the expression:

$$R_m = \frac{1}{2}\frac{T_f}{\Delta T}, \tag{3}$$

where $T_f$ is the time-of-flight and ΔT is the full width at half maximum height (FWHM) of a peak associated with a single mass-to-charge ratio in the ToF spectrum.

$\Delta T_{turn_around}$ contributes to the overall value of ΔT according to the following expression:

$$\Delta T = \sqrt{\Delta T_{detector}^2 + \Delta T_{turn\text{-}around}^2 + \Delta T_{t_jitter}^2 + \Delta T_{chro_ab}^2 + \Delta T_{sph_ab}^2} \quad (4)$$

It is generally the case that $\Delta T_{turn_around}$ is of a similar value to $\Delta T_{detector}$, $\Delta T_{t_jitter}$, $\Delta T_{chro_ab}$ and $\Delta T_{sph_ab}$, and so even a modest reduction in $\Delta T_{turn_around}$ due to a reduction in the RMSV can provide some improvement in the resolving power.

Also, because the ion cloud has a reduced physical size in the transverse extraction direction, ions will have a reduced energy spread (and so a reduced $\Delta T_{chro_ab}$) when they are ejected from the ion trap by application of an extraction voltage, and this also results in improving resolving power.

Generally, it is difficult to terminate a trapping field, when it is produced by a high Q resonant LC circuit. As a result the ion cloud is afforded too much time to expand prior to the application of the extraction field. A method to overcome these problems was described in WO 2005/083742. This describes providing the trapping field by using a number of fast electronic switches, thus allowing the trapping field to be terminated with a high degree of precision relative to the phase of the trapping waveform and then after a small predetermined delay, switching to a state in which all ions move from the ion trap towards the time-of-flight mass spectrometer.

A problem associated with conventional 3D ion traps is that they have low charge capacity. This is because the quadrupole field associated with a 3D Ion Trap compresses ions towards a single point in space, and so the ion cloud will occupy a small volume centred around this point. This limited charge capacity compromises the 'dynamic range' and the ion throughput of the device. When the dynamic range is low, the number of ions in each mass spectrum will be limited and so a number of individual spectra might need to be accumulated over an extended time to achieve good fidelity. This accumulation process increases the analysis time as well as limiting the ability to follow fast chromatography.

A further disadvantage associated with low dynamic range is that the mass accuracy that can be attained from the ToF analyser may be compromised. To attain the highest mass accuracy each mass spectrum should contain internal calibration peaks, these peaks of known m/z value can be used to correct for small shifts in the mass axis due to, for example, short term drift and instability in the power supplies. This method of calibration only yields successful results if the peaks within a single spectrum are of sufficient intensity to precisely determine the peak position.

When considering the charge capacity of an ion trap resulting from a particular field configuration, the concept of 'critical charge' is useful. The critical charge of a classical 3D ion trap can be expressed as:

$$Q_{crit_3d} := \frac{(K \cdot T \cdot 8\pi \cdot \varepsilon_o) \cdot \sigma_z}{q^2} \quad (5)$$

K is Boltzman constant, T, is temperature $\epsilon_o$ is the permittivity, and q is unit charge. The term $\sigma_z$ provides a measure of the radius of the ion cloud in the z dimension, this is half the value of $\sigma_r$, the radius of the cloud in the radial dimension. $Q_{crit_3d}$ represents the quantity of charge that can be loaded into the ion trap before the onset of space charge effects. When the loaded charge, Q, exceeds the critical charge, $Q_{crit_3d}$, ions start to experience an interaction potential due to the presence of the other ions in the ion cloud (space charge effects) in addition to the applied quadrupole field. When the ion trap is operated above the critical charge density, the size of the equilibrated ion cloud is dictated by the space charge rather than the temperature of the ion cloud. Additionally, the critical charge marks the onset of ion stratification phenomena.

It should be noted that the critical charge is much lower than the maximum storage charge capacity of the device. In the case of the classical 3D ion trap, $Q_{crit_3d}$ is dependent upon the size of the ion cloud, which is determined by q. In an IT-ToF instrument all m/z values of interest must remain within certain limits defined by the size of the exit aperture through which the ion cloud must pass to get to the ToF analyser. The trapping conditions that must be employed are determined by the upper m/z value one wishes to observe in the mass spectrum.

The corresponding critical charge for a two dimensional quadrupole field is given by:

$$Q_{crit_2d} := \frac{K \cdot T \cdot (2\pi \cdot \varepsilon_o \cdot L)}{q^2} \quad (6)$$

Unlike $Q_{crit_3d}$, $Q_{crit_2d}$ is independent of the cloud size parameters $\sigma_x$ and $\sigma_y$, and is therefore independent of the ions m/z value.

Another difference is that $Q_{crit_2d}$ can be increased by increasing the length of the ion cloud in the z direction (L). However, in practice L is limited by the Z dimension emittance that can be accepted by the ToF analyzer, known as the 'acceptance'. A practical limit is L≈10 mm. In this case the critical charge can be calculated, using the above equations to be ~25 times greater for the 2D quadrupole field case (assuming similar dimensions of exit apertures and trapping conditions). Thus the 2D quadrupole field provides the possibility for a large increase in the dynamic range and ion throughput, in comparison to a 3D quadrupole field.

A 2D quadrupole field has several other advantages as an ion source for a ToF compared to a 3D quadrupole field. Ions can be introduced into the 2D quadrupole trapping field with much increased efficiency compared to a 3D quadrupole field over a wide mass range. Ions may be efficiently introduced along the axis which coincides with the minimum of the psuedopotential well. However, the emittance that is obtained from an axially extending ion cloud, that is cooled within a 2D quadrupole field is larger than will be accepted by some types of ToF analyzer.

Known LIT-ToF systems have a mechanism for ion loss during ion introduction, (see for example U.S. Pat. No. 5,763,878). A significant number of ions may be lost in the fringe field region between the 2D quadrupole field and the preceding and proceeding ion optical transport devices/elements. The efficiency of ion transfer into the device will depend on the form of the fringe field and the mass range of the ions to be analysed.

The 3D ion trap-ToF instrument has a maximum acquision rate in an MS mode of ~10 spectra per second, and in an MS/MS mode of ~5 spectra per second. By comparison the LIT-ToF apparatus as described in U.S. Pat. No. 5,763,878 suggests that an acquisition rate of 10000 spectra per second is possible. However at such a rate, the advantages afforded by using a linear ion trap can not be realized as the trapped ions are not given sufficient time to cool. In addition a high proportion of the trapped ions will also be lost. Furthermore, such high acquisition rate is unnecessary in most applications and the ion throughput suggested is higher than can actually be provided by most ion sources. A 10 mm long ion cloud in a LIT can deliver ~$10^5$ ions to the ToF analyzer. At an acquisition rate of $10^4$ spectra/second a total current of $10^9$ ions second is transported into the ToF analyzer, and this high current is equivalent to a continuous current of 160 pAmps and represents the saturation current that can be delivered by an electrospray ion source. To cool ions sufficiently to ensure that optimum performance is obtained from the ToF analyzer, a maximum rate of analysis of 100 spectra per second is more reasonable, and this is adequate for most purposes.

When performing MS/MS analysis within a 3D an ion trap, each stage of MS analysis is done sequentially. This is known as 'tandem in time' analysis. For each stage of MS/MS analysis it is necessary to carry out the following steps cooling, isolation, cooling, excitation, cooling. These processes are time consuming. The total time taken will depend on the resolution required in the isolation step, but typically the overall cycle time is ~200 ms. This imposes limits of ~5 $MS^2$ spectra per second or 2 $MS^3$ spectra per second. The low acquisition rate is compounded by the limitation of the charge capacity of the 3D ion trap. The isolation limit for a 3D ion trap is ~10000 ions depending on how the ions are distributed in m/z. However, the ions of interest that will remain after the isolation step may be typically ~5% of the initial number. Thus, in a typical $MS^2$ experiment the ion throughput is typically only 2500 ions per second, and in a typical $MS^3$ experiment the ion throughput will be as low as 50 ions per second. Therefore there is a requirement for ion-trap ToF instruments to have improved ion throughput rates and spectrum acquisition rates, particularly for $MS^2$ and $MS^3$ analysis modes.

According to the invention there is provided a time-of-flight mass spectrometer comprising: an ion source for supplying sample ions; a segmented linear ion storage device having a longitudinal axis for receiving sample ions supplied by the ion source; voltage supply means for supplying to the device: (i) a trapping voltage which, with the assistance of cooling gas, is effective to trap sample ions, or ions derived from said sample ions in an axially-extending region of said device, said axially-extending region comprising a trapping volume of a group of two or more mutually adjacent segments of said device and to cause ions trapped in said axially-extending region subsequently to become trapped in an extraction region of said axially-extending region to form an ion cloud, said extraction region being shorter than said axially extending region, and (ii) an extraction voltage for causing ejection of the ion cloud from said extraction region in an extraction direction orthogonal to said longitudinal axis of said device, and a time-of-flight mass analyser for performing mass analysis of ions ejected from said extraction region.

In a preferred embodiment of the invention said extraction region comprises the trapping volume of one single segment of said group of segments.

Preferably, the voltage supply means is arranged to supply an RF trapping voltage to said device to create a quadrupole trapping field which is substantially uniform along and between adjacent segments of the device, to enable ions to pass between adjacent segments without substantial loss of ions.

Further preferably, adjacent segments of said segmented device have substantially the same radial dimension.

In a preferred embodiment, the spectrometer comprises ion cloud treatment means for reducing the physical size of and/or velocity spread of ions in the ion cloud, in directions transverse to the longitudinal axis before said extraction voltage is applied. This has the effect of reducing the emittance of the ion cloud when it is ejected from the extraction region. The ion cloud treatment means may be arranged to increase the trapping voltage applied to an extraction segment (so called "burst compression") and/or to impose a delay between termination of said trapping voltage and application of said extraction voltage.

In preferred embodiments, further segments of the device may act as storage segments and/or fragmentation segments and/or filtering segments.

According to the invention there is also provided a method of analysing ions using a time-of-flight mass spectrometer comprising the steps of receiving sample ions to be analysed in a segmented linear ion storage device having a longitudinal axis; applying trapping voltage to said device, which, with the assistance of cooling gas, is effective to trap sample ions, or ions derived from sample ions in an axially-extending region of said device, said axially extending region comprising a trapping volume of a group of two or more mutually adjacent segments of said device and to cause ions trapped in said region subsequently to become trapped in an extraction region of said axially-extending region to form an ion cloud, said extraction region being shorter than said axially-extending region; applying an extraction voltage to the device, to cause ejection of said ion cloud from said extraction region in an extraction direction orthogonal to said longitudinal axis of said device; and analysing said ejected ions using a time-of-flight mass analyser.

In a preferred embodiment the method includes the step of supplying an RF trapping voltage to said device to create a quadrupole trapping field which is substantially uniform along and between adjacent segments of said device, to enable ions to pass between adjacent segments without substantial loss. Preferably, the quadrupole trapping field is substantially uniform along with entire length of the device.

According to the invention there is further provided a time-of-flight mass spectrometer comprising: an ion source for supplying sample ions: a segmented linear multipole ion device having a longitudinal axis for receiving sample ions supplied by the ion source; voltage supply means for supplying to the device;

(i) an RF trapping voltage to create a multipole trapping field which is substantially uniform along and between adjacent segments of said device, to enable ions to pass between adjacent segments without substantial loss of ions.

(ii) a DC trapping voltage, which, with the assistance of cooling gas, is effective to trap sample ions, or ions derived from sample ions in an extraction region of said device to form an ion cloud, and (iii) an extraction voltage for causing ejection of the ion cloud from said extraction region in an extraction direction orthogonal to said longitudinal axis of said device, and a time-of-flight mass analyser for performing mass analysis of ions ejected from said extraction region.

According to the invention there is also further provided a method of operating a time-of-flight mass spectrometer comprising the steps of: receiving sample ions in a segmented linear multipole ion storage device having a longitudinal axis; applying an RF trapping voltage effective to create a multipole trapping field which is substantially uniform along and between adjacent segments of said device, to enable ions to pass between adjacent segments without substantially ion loss;

applying a DC trapping voltage, which, with the assistance of cooling gas is effective to trap sample ions, or ions derived from sample ion in an extraction region of said device to form an ion cloud, and applying extraction voltage for causing ejection of said ion cloud from said extraction region in an extraction direction orthogonal to said longitudinal axis of said device, and analysing ejected ions using a time-of-flight mass analyser.

According to the invention there is further provided a time-of-flight mass spectrometer comprising, an ion source for supplying sample ions, a segmented linear ion storage device having a longitudinal axis for receiving sample ions supplied by the ion source, voltage supply means for supplying RF multipole trapping voltage to the device, for selectively supplying DC voltage to segments of the device to cause sample ions, or ions derived from sample ions to move between different axially-extending regions of the device where ions selectively undergo MS processing, and for causing processed ions to become trapped in the trapping volume of an extraction segment of the device, and for supplying an extraction voltage to the extraction segment to ejected trapped ions in an extraction direction, orthogonal to said longitudinal axis of the device, and a time-of-flight analyser for performing mass analysis of ions ejected from the extraction segment.

BRIEF DESCRIPTION OF THE DRAWINGS

Embodiments of the invention are now described, by way of example only, with reference to the accompanying drawings in which;

FIGS. 21(*b*) and 21(*c*) show the respective voltages applied to the X and Y rods of the extraction segment as a function of time during the burst compression process;

Referring now to the drawings, FIG. 1 shows a schematic overview of a ToF mass spectrometer according to an embodiment of the invention.

Figure 1:
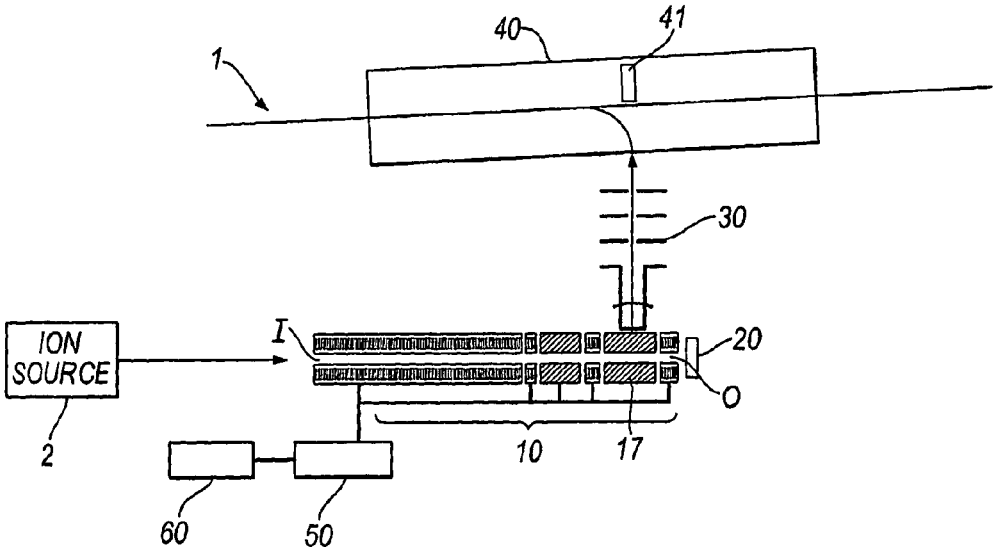
FIG. 1 shows a cross-sectional view of a ToF mass spectrometer of a preferred embodiment of the invention.

The spectrometer 1 comprises an ion source 2, a segmented linear ion storage device 10 having an entrance end I for receiving ions supplied by the ion source 2 and an exit end O, a detector 20 positioned adjacent the exit end O for detecting ions exiting the exit end O, a ToF mass analyser 40 having a detector 41 and ion focusing elements 30.

The spectrometer also includes a voltage supply unit 50 for supplying voltage to segments of the ion storage device 10 and a control unit 60 for controlling the voltage supply unit. In this embodiment, the ToF mass analyser 40 comprises a reflectron; however, any other suitable form of ToF analyser could a alternatively be used; for example, an analyser having a multipass configuration.

Figure 2:
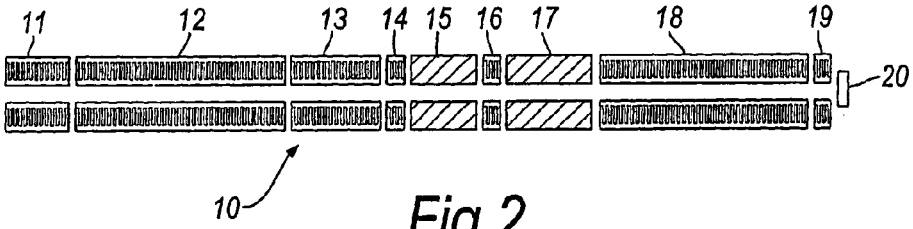
FIG. 2 shows a cross-sectional view of a segmented linear ion storage device used in one embodiment of the invention.
Figure 3:
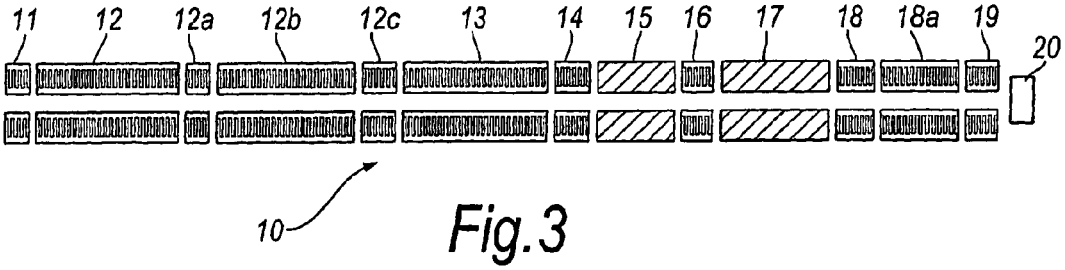
FIG. 3 shows a cross-sectional view of a segmented linear ion storage device used in an alternative embodiment of the invention.

FIGS. 2 and 3 show longitudinal sectional views of different embodiments of the segmented linear ion storage device 10. The device shown in FIG. 2 has nine discrete segments 11 to 19, whereas, the device shown in FIG. 3 has thirteen discrete segments, including three additional segments 12*a*, 12*b* and 12*c* between segments 12 and 13 and an additional segment 18*a* between segments 18 and 19.

In preferred embodiments, device 10 is a quadrupole device. Alternatively, though less desirably, a different multipole device could be used, e.g. a hexapole device or an octopole device. In the embodiments which follow, it will be assumed that device 10 is a quadrupole device. In the case of a quadrupole device, each segment may comprise four poles (e.g. rods) arranged symmetrically around a common longitudinal axis, although a configuration formed from a series of flat plate electrodes could alternatively be used, as will be described in greater detail hereinafter.

In operation, voltage supply unit 50 supplies RF trapping voltage to the segments to produce a two-dimensional quadrupole trapping field within the trapping volume of the segments. In effect, the trapping field creates a pseudopotential well, with the bottom of the well being centred on the longitudinal axis. By this means, ions having a predetermined range of mass-to-charge ratio, determined by characteristics of the trapping voltage, as expressed by the aforementioned Mathieu parameters a, q, can be trapped in the radial direction, the trapping field tending to constrain ions to accumulate on or near to the longitudinal axis at the bottom of the potential well.

The voltage supply unit 50 is also arranged selectively to supply DC bias voltage to segments of the device. As will be described in greater detail hereinafter, DC voltage selectively supplied to segments may fulfil different operational functions depending on a required mode of operation.

For example, DC voltage supplied to segments can be used to create a DC potential gradient along the device causing ions to pass between segments as they move down the potential gradient. DC voltage supplied to segments can also be used to create a DC potential well within the trapping volume of a single segment or within the trapping volume of a group of two or more mutually adjacent segments.

In preferred embodiments, DC voltage supplied to segments of the device 10 creates a relatively wide DC potential well within the trapping volume of a group of two or more mutually adjacent segments. The DC potential well is arranged to be deeper within the trapping volume of one (or possibly more than one) segment of the group than within the trapping volume of the other segments of the group. Initially, ions become trapped in a relatively wide axially-extending region of the device 10 defined by the trapping volume of the entire group of segments and as the trapped ions lose kinetic energy, due to collisions with cooling gas, they progressively sink to the bottom of the potential well and are thereby confined, in the axial direction, within a relatively narrow region of the device 10 where they form an ion cloud.

In particularly preferred embodiments, an ion cloud is formed in this manner within the trapping volume of an extraction segment of the device (segment 17 of FIG. 1) and is subsequently ejected from that segment in an extraction direction orthogonal to the longitudinal axis by application of an extraction voltage to the segment. The ejected ions are then analysed using the ToF analyser 40.

By this measure, the efficiency with which ions having a wide mass range (for example, as great as say a factor of 10 between the highest and lowest masses) are cooled within the device 10 to form an ion cloud is improved, giving increased ion throughput and improved sensitivity and dynamic range.

It has been found to be beneficial to arrange for the quadrupole trapping field to be substantially uniform along and between adjacent segments of the device 10 to enable ions within a wide mass range to pass between segments without substantial loss of ions, again giving improved dynamic range and enhanced ion throughput.

Voltage supplied by voltage supply unit 50 under the control of control unit 60, may cause a segment or a group of segments of device 10 selectively to perform one or more of a range of different operational functions including trapping, storing, isolating, fragmenting, filtering and extracting ions, as required by a particular mode of operation of the spectrometer 1.

By an appropriate selection of DC voltage, ions can be caused to move axially between different regions of the device 10 where different operational functions may be performed, and it is possible for the same segment or the same group of segments to perform different operational functions at different stages of the operation, and for different segments or groups of segments to perform different operational functions at the same time.

The segmented device 10 may be arranged so that different segments or different groups of segments are located in different vacuum chambers, maintained at different pressures and separated by aperture plates located within the gap between segments, with each segment and associated aperture having a separate voltage supply unit.

The segmented device 10 may be operated so that all segments operate at the same frequency, voltage and phase; alternatively, at least one segment may be operate at a different frequency, voltage and phase, but may be switched at any time to operate under the same conditions as the other segments.

It will be appreciated that control unit 60 may be so configured that the spectrometer has a single mode of operation; alternatively, the spectrometer may selectively operate in any one of a number of different modes of operation.

Examples of preferred modes of operation are now described.

A first mode of operation of the device is now described with reference to FIG. 4. In this mode of operation the spectrometer can produce an MS spectrum with a variable duty cycle. For example, a single ToF spectrum may be produced using ions supplied to segment 11 (the entrance segment) in the form of a continuous beam.

Figure 4:
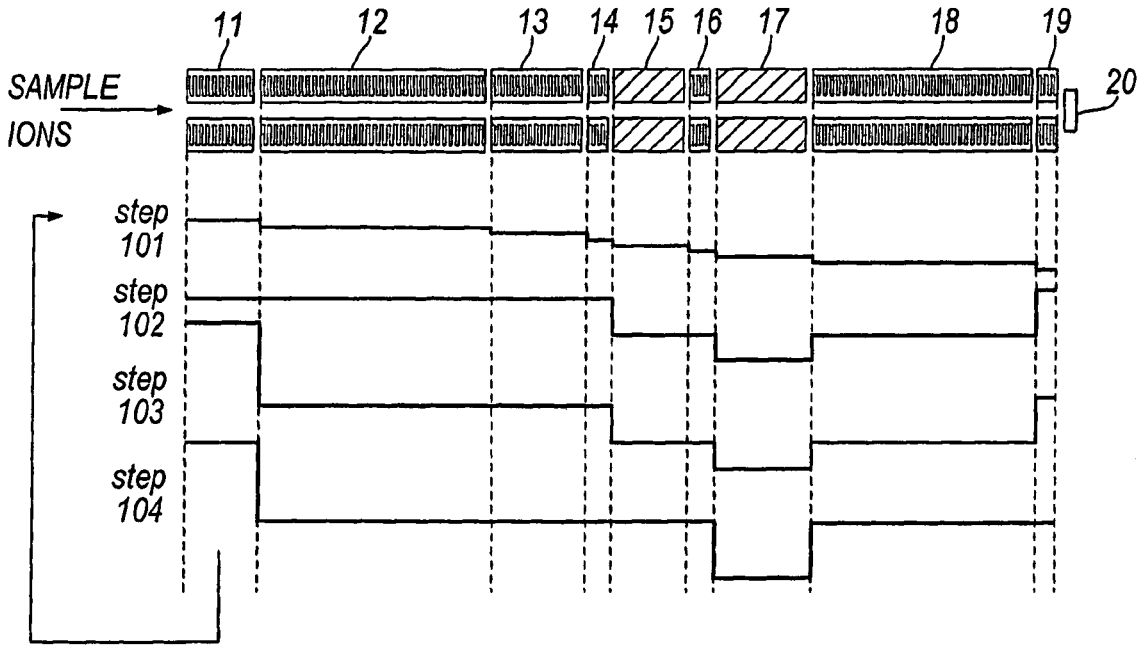
FIG. 4 illustrates DC bias voltage supplied to each segment of the segmented device of FIG. 2 during each stage of a complete cycle of an MS experiment, in a first mode of operation of the spectrometer.

As shown in FIG. 4, in step 101 a suitable set of DC and RF trapping voltages is applied to all the segments of device 10. Precisely how the voltages are applied to the segments is described below with reference to FIGS. 5-9. The applied voltages are such as to allow ions entering through segment 11 to pass along the entire length of the device (through all segments 11-19), to pass out of segment 19 to be detected by ion detector 20. This is because the DC voltage supplied to the segments by the voltage supply unit 50 progressively decreases along the axial length of device 10, causing ions to pass between segments as they move down the potential gradient so created. The ion current detected at detector 20 over a predetermined duration is accumulated and stored in control unit 60.

The next step is step 102 which occurs after a suitable fixed duration. In this step, the RF trapping voltage is unchanged from step 101, but the DC voltages are adjusted to allow ions entering the device 10 to become initially trapped within a potential well created within segments 15-18. A cooling buffer gas (e.g. a noble gas such as He) is provided within all segments of the device 10. As the trapped ions in segments 15-18 collide with the buffer gas they lose kinetic energy, and this will cause the trapped ions to eventually accumulate at the position of lowest axial DC potential, in this case in the extraction segment 17.

After a time duration determined according to the accumulated ion current measured in step 101, the DC voltages shown in step 103 are applied to the device 10. The voltage on segment 11 is considerably higher than the voltage on all of the remaining segments and this prevents further ions entering the device 10 through segment 11. The previously accumulated ions in segments 15-18 are given additional time to collide with the buffer gas, and this ensures that the maximum number of ions are confined within the extraction segment 17. After a few milliseconds the ions in the extraction segment 17 will reach thermal equilibrium with the buffer gas.

In step 104 the DC voltages are adjusted to confine the ion cloud in segment 17 axially within a central portion of the segment, and this will reduce the emittance of the ion cloud within the segment when it is ejected from the extraction segment.

After step 104, an extraction voltage (not shown) is applied to segment 17 to extract ions from the segment 17 in an extraction direction orthogonal to the longitudinal axis of the segmented device 10, for analysis by the ToF analyser. Again, the precise application of the extraction voltage will be described shortly, with reference to FIGS. 10-12. Steps 101-104 can then be repeated, to provide further ions to be extracted from segment 17 for analysis by the ToF analyser.

This particular mode of operation prevents charge overloading of the segmented device 10, by measuring the incoming ion beam current with detector 20 and using this measurement of ion current to adjust the duty cycle of the device 10. This method is desirable because if charge overloading of device 10 occurs, ions of higher m/z ratio will be preferentially discriminated, or may even be completely lost. The duty cycle achieveable using this method depends on the duration of step 102 as compared to the overall cycle time.

In this mode of operation, when the ion beam current is high the duty cycle will be correspondingly reduced.

Figure 5:
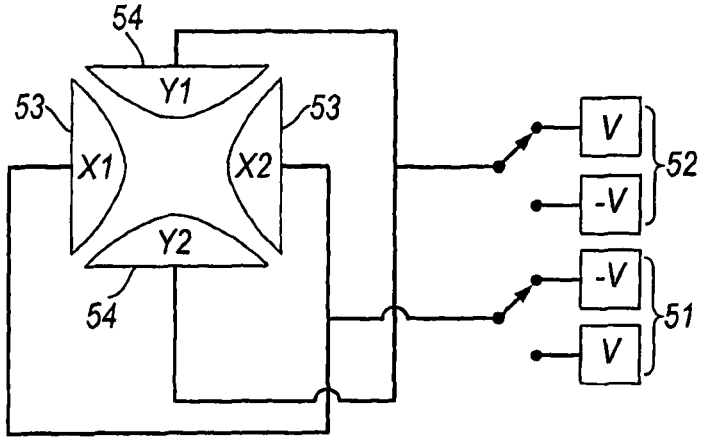
FIG. 5 shows an arrangement using 2 pairs of digitally-controlled switches for applying a trapping waveform to the segmented device.
Figure 6:
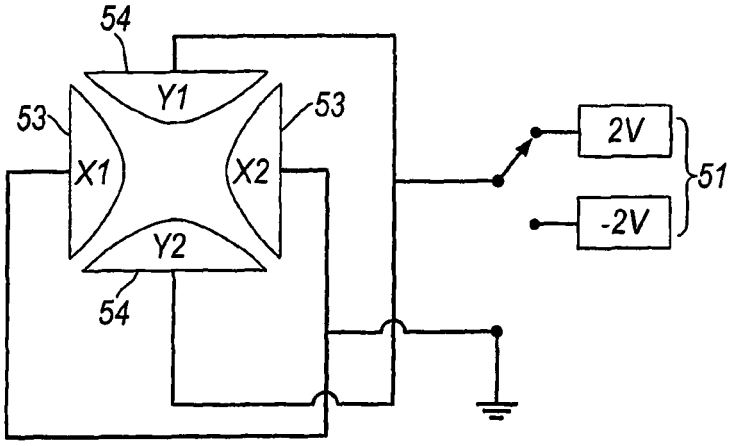
FIG. 6 shows an alternative switching arrangement using a single pair of switches.
Figure 7:
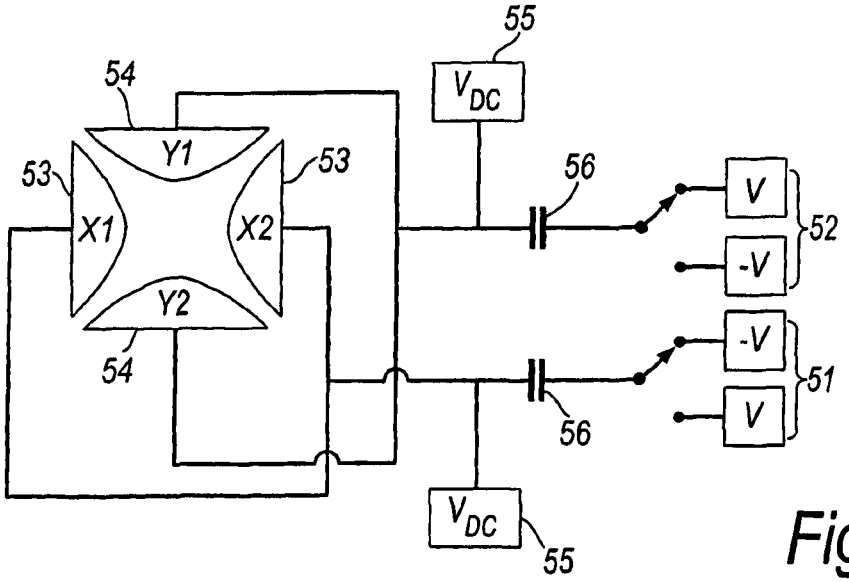
FIG. 7 shows an alternative switching arrangement using 2 pairs of switches connected to the segmented device via capacitors.

FIGS. 5-7 show alternative switching arrangements used to apply an RF trapping waveform to the segmented device.

In FIG. 5, the trapping waveform is applied using two pairs of digitally controlled switches 51, 52 connected to X poles 53 and Y poles 54 respectively of a quadrupole segment of device 10. This will produce an RF trapping waveform within the segment. Alternatively, the RF trapping waveform may be generated using the arrangement of FIG. 6, which has a single pair of switches 51, connected to the Y rods 54. The X rods are connected to ground.

Figure 8:
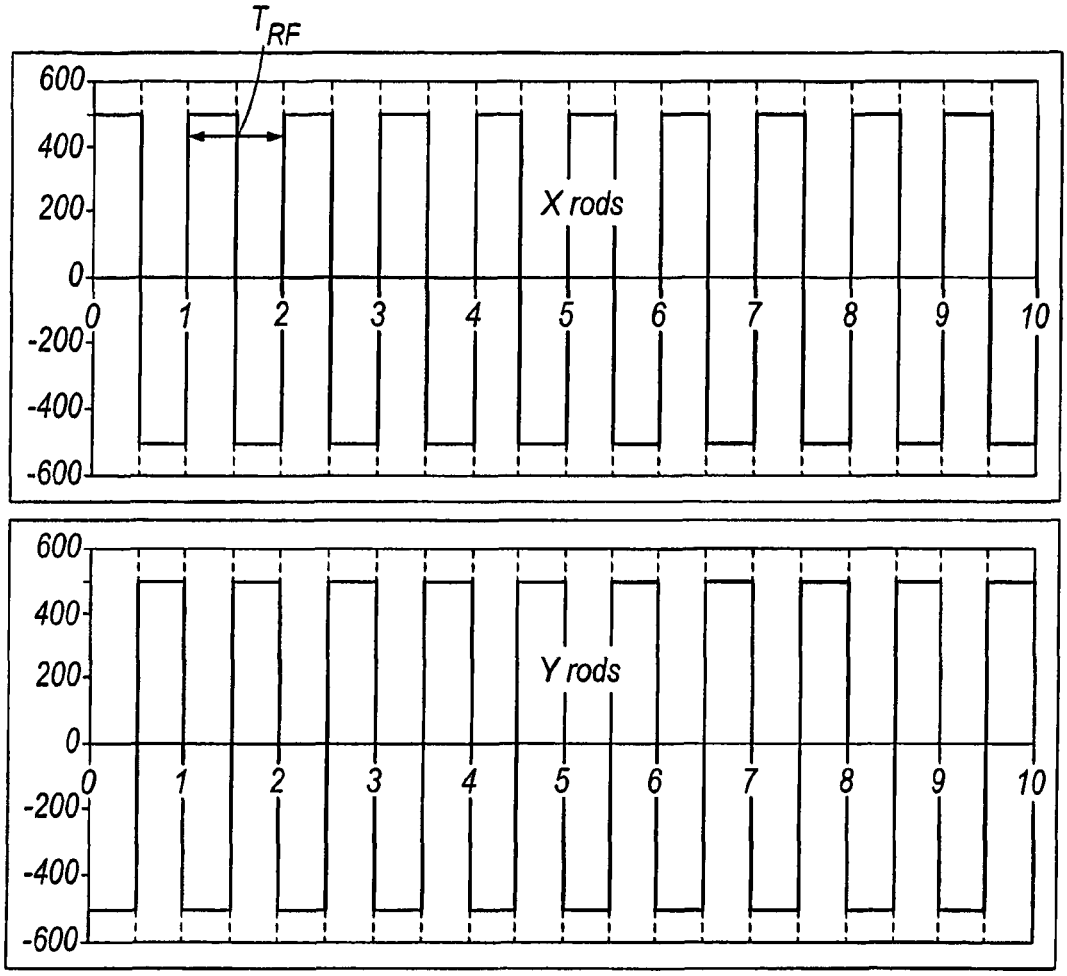
FIG. 8 shows a typical RF trapping waveform applied to the segmented device.

A typical RF waveform resulting from the switching arrangements show in FIG. 5 is shown in FIG. 8. This shows a square wave with a 50% duty cycle. The amplitude of the waveform, and period $T_{RF}$ are selected according to the m/z range of ions to be trapped within the segment. As can be seen, the RF trapping waveform of FIG. 8 has no DC component with reference to ground.

Further details on the use of digitally controlled switches to produce an RF trapping waveform are provided in WO 01/29875 (Ding).

FIG. 7 shows a switching arrangement which can be used to introduce a DC offset between segments of the device 10, or between the X and Y rods within one segment of the device 10.

In this case, the switches 51, 52 are connected to the X and Y rods 53, 54 via a capacitor 56. The circuitry also includes element 55 for introducing a DC offset between the segments, or for introducing a DC offset between the X and Y rods 53, 54 within one segment of device 10.

Figure 9:
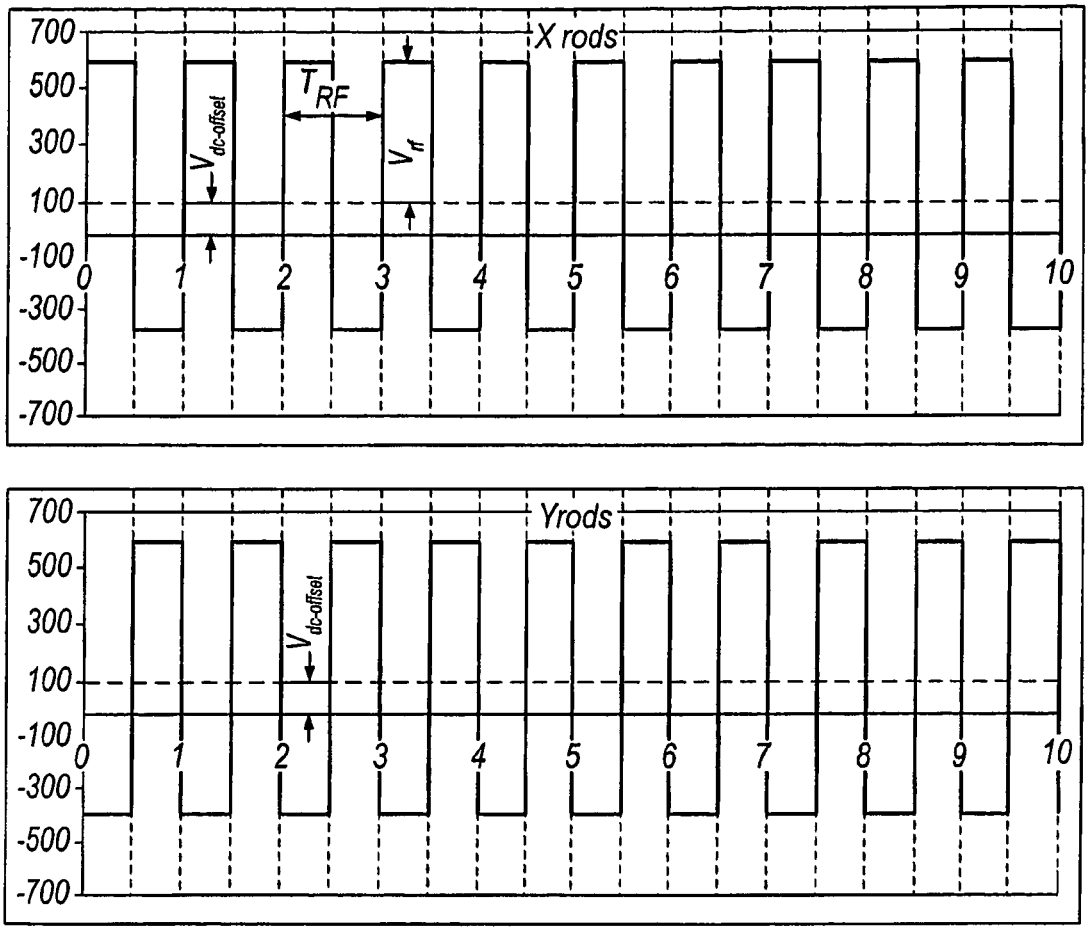
FIG. 9 shows a typical RF trapping waveform having a DC voltage applied between the X and Y rods.

FIG. 9 shows the resulting RF trapping waveform with the applied DC offset voltage. In this example, the same voltage is applied to the X and Y rods. The DC offset may be the same or different for each of the segments in the device 10 and is set for example, to trap an ion cloud axially within a group of segments, to trap an ion cloud within one segment of the group, or to introduce an axial field to cause ions to travel from the entrance segment 11 to the exit segment 19 of the device 10.

The application of the extraction voltage to the segmented device 10 will now be described with reference to FIGS. 10-12.

Figure 10:
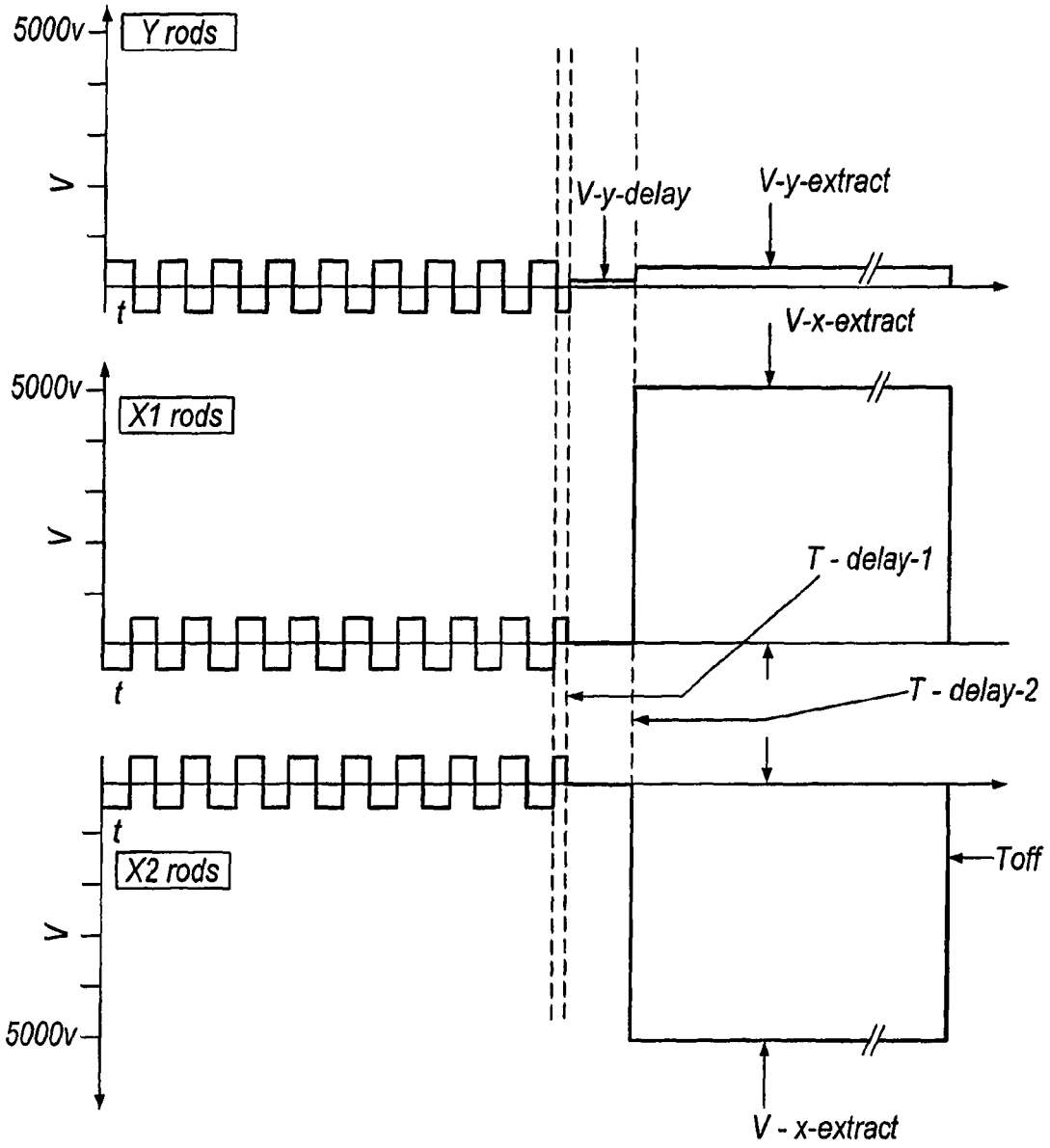
FIG. 10 shows the voltages applied to the X and Y rods of an extraction segment of the segmented device to cause ejection of ions from the extraction segment.

FIG. 10 shows the voltages applied to the X and Y rods of the extraction segment 17 during the extraction step.

Between t=0 and $t=T_{delay\text{-}1}$ ions are confined in segment 17 by the RF trapping waveform applied to the X and Y rods of the extraction segment 17. At time, $t=T_{delay\text{-}1}$, (which corresponds a particularly favourable phase of the RF cycle) the trapping voltage is terminated; the voltage on the X rods is set to zero and the voltage on the Y rods is set to $V=V_{y\text{-}delay}$. Between time $t=T_{delay\text{-}1}$ and $t=T_{delay\text{-}2}$ the rods are maintained at these voltages.

At $t=T_{delay\text{-}2}$ the voltage on the Y rods is set to a different DC voltage; $V=V_{y\text{-}extract}$. Simultaneously, the extraction voltages $+V_{x\text{-}extract}$ and $-V_{x\text{-}extract}$ are applied to the X1 and X2 rods respectively. This causes all ions to be ejected from the extraction segment 17 through the X2 rod. At $t=T_{off}$ the voltages on all rods are set to zero to stop the extraction.

The delay introduced between $t=T_{delay\text{-}1}$ and $t=T_{delay\text{-}2}$ effectively gives rise to a reduced velocity spread in directions transverse to the longitudinal axis before the extraction voltage is applied. In this case, the area occupied by the ion cloud in "velocity-position" phase space is substantially unchanged; that is, the physical size of the ion cloud in the extraction direction increases because the ion cloud is no longer constrained by the RF field, and it expands in the relatively weaker constant quadrupole field. Correspondingly, the initial phase space ellipse of the ion cloud transforms from one which is initially upright to one which is stretched and tilted, and the position and velocity of the ions are correlated. As the area of the phase space ellipse remains constant during expansion of the ion cloud, the velocity spread in the X direction must correspondingly reduce.

Intermediate voltages may be applied to the X and Y rods during the delay period to manipulate the ion cloud in the extraction segment 17 and further reduce the velocity spread in the X direction. By reducing the velocity spread in this way the overall resolving power of the spectrometer can be improved. Alternatively, different voltages may be applied during the delay period to provide spatial focusing of the extracted ion beam to be provided to the ToF analyser.

Typically, the extraction voltage is at least 5 kV with a rise time of approximately 50 ns.

Figure 11:
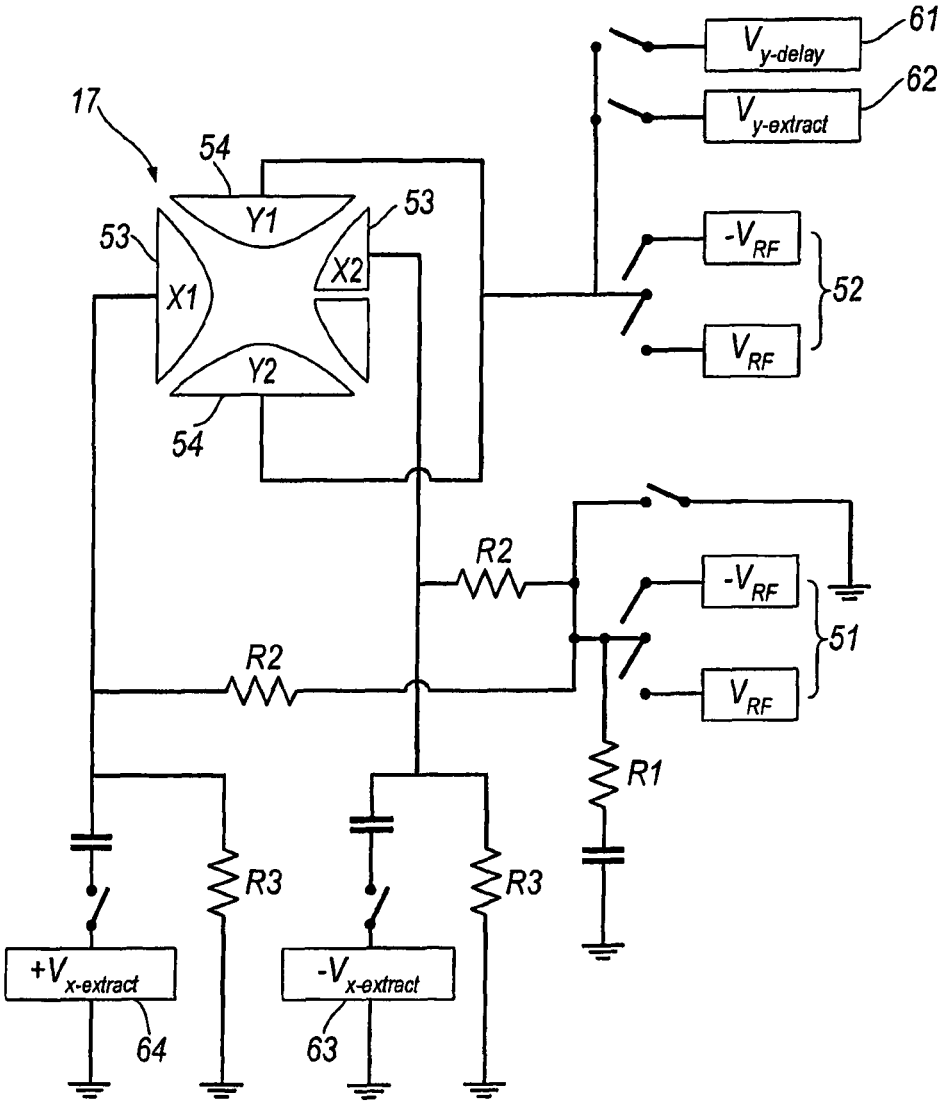
FIG. 11 shows a switching arrangement for applying the extraction voltage to the extraction segment of the segmented device.

FIG. 11 shows a possible circuit for applying the extraction voltages described with reference to FIG. 10. As described with reference to FIGS. 5-7, switches 51 and 52 apply the RF trapping waveform to X rods 53 and Y rods 54 respectively. Switches 61, 62 apply the delay and extraction voltages to the Y rods and switches 63 and 64 apply the extraction voltages to rods X2 and X1 respectively.

Figure 12:
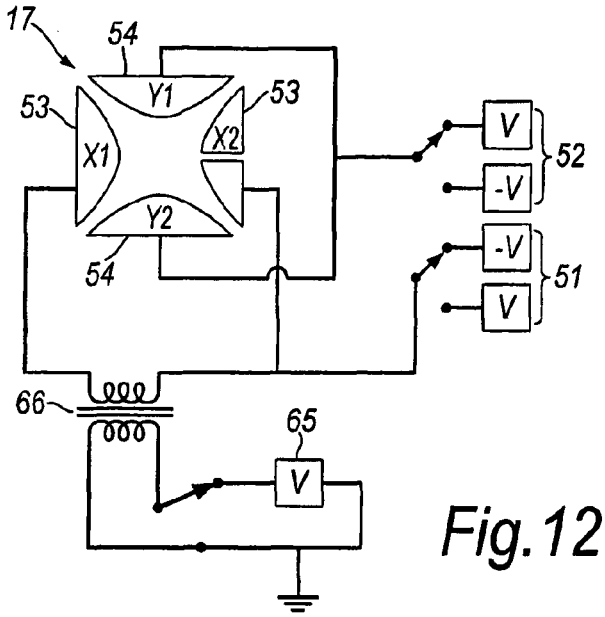
FIG. 12 shows an alternative switching arrangement for applying the extraction voltage to the extraction segment of the segmented device.

FIG. 12 shows an alternative circuit for applying an extraction voltage to extraction segment 17. This circuit uses a lower voltage switch 65 connected to a high bandwidth step-up transformer 66 to provide the extraction voltage. The secondary windings of transformer 66 are preferably wound in a bifilar configuration.

As well as applying to the above described first method these methods of applying trapping/DC voltages and the extraction voltages are also applicable to further modes of operation described hereinafter.

Figure 13:
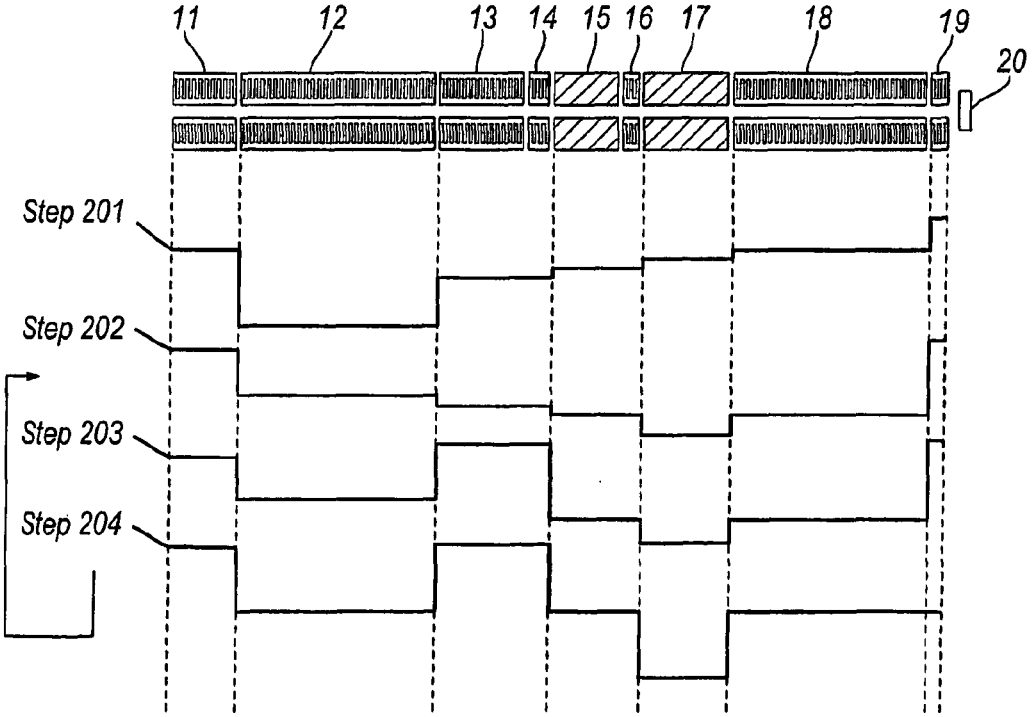
FIG. 13 illustrates DC bias voltage supplied to each segment of the segmented device of FIG. 2 during each stage of a complete cycle of an MS experiment, in a second mode of operation of the apparatus.

FIG. 13 shows a second mode of operation of the device 10. This method may achieve a 100% duty cycle.

In step 201, a suitable set of DC and RF trapping voltages are applied to all the segments of device 10. These voltages allow ions to enter device 10 through entrance segment 11 and to be initially confined within a wide DC potential well created within segments 12 to 18. As the trapped ions in segments 12-18 collide with buffer gas they lose kinetic energy, and this will cause them to accumulate at the bottom of the DC potential well, in this case in segment 12.

In step 202 the applied DC and RF voltages are adjusted. The adjusted voltages are such that the ions trapped within segment 12 in step 201 move into segments 15-18; that is to say, they move down the potential gradient created by the adjusted voltages, whilst sample ions are still able to enter the device 10 through entrance segment 11.

In step 203 the applied voltages are again adjusted. The applied voltage is effective to cause the ions transferred to segments 15-18 in step 202 to be initially trapped in these segments. As in step 201, the trapped ions collide with buffer gas and lose kinetic energy, eventually ending up in the segment with the lowest DC potential, in this case, in the extraction segment 17, where they will eventually reach thermal equilibrium with the buffer gas. Whilst these ions are being trapped in segments 15-18 and eventually segment 17, more sample ions are entering device 10 through entrance segment 11 and being trapped in segment 12.

Step 204 is similar to step 104 of FIG. 4. In this step the voltages are adjusted to confine the ion cloud within extraction segment 17 axially, within a central portion of segment 17. This step reduces the emittance of the ion cloud within the segment 17, when it is ejected from the extraction segment.

After step 204 the extraction voltage (as described above) is applied to extraction segment 17. Steps 201-204 and the extraction step are cycled through continuously.

This method of operation is particularly useful when the incident ion beam current is high, as in this case the time needed to fill the device 10 may be short compared to the overall time to complete the cycle and acquire a mass spectrum.

However, if the incoming ion beam current exceeds the maximum charge throughput capability of device 10, then the charge capacity of device 10 will be exceeded, and detrimental effects due to charge overloading will arise.

Figure 14:
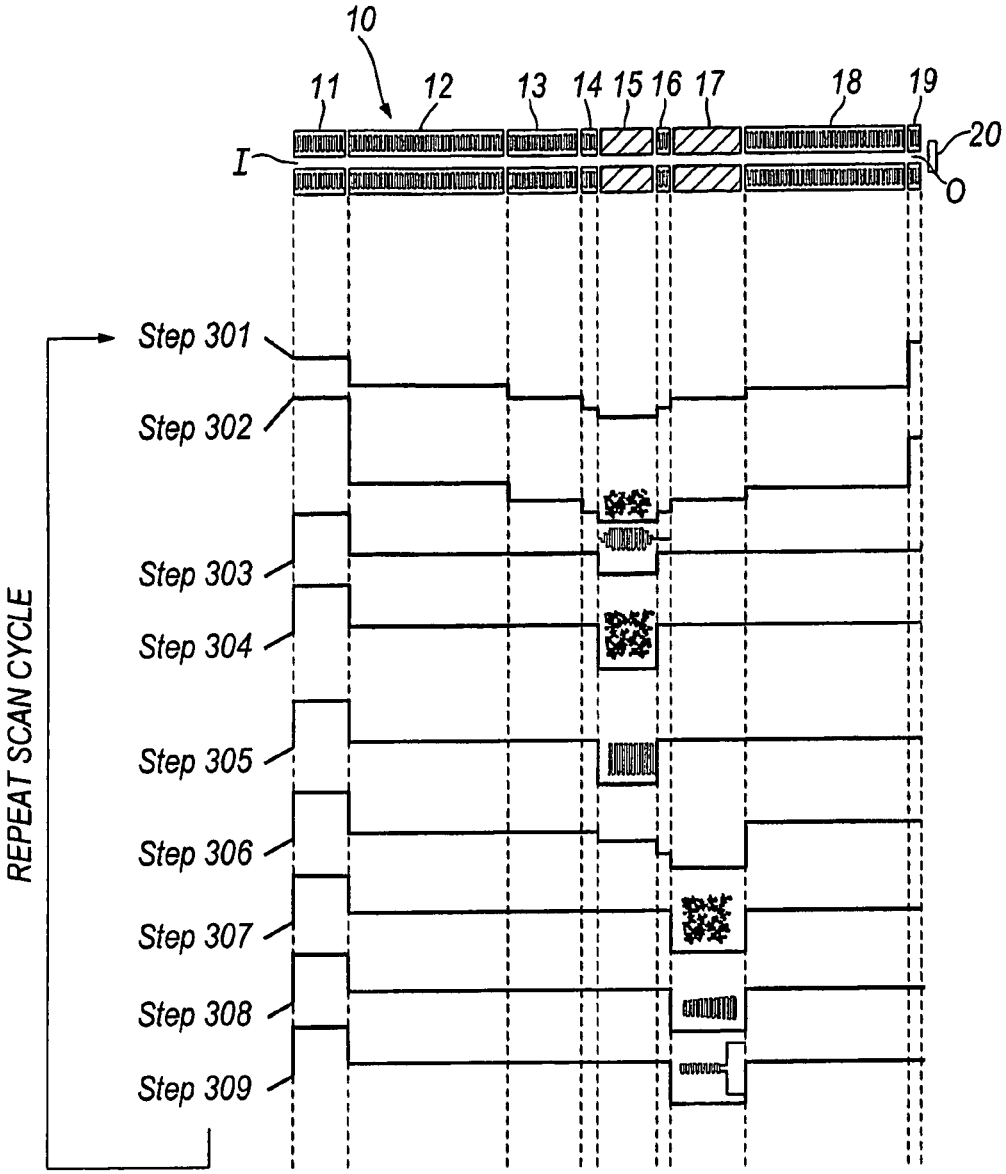
FIG. 14 illustrates DC bias voltage supplied to each segment of the segmented device of FIG. 2 during each stage of a complete cycle of an MS experiment in a third mode of operation of the apparatus.

FIG. 14 shows a third mode of operation of the device 10. This method of operation uses a precursor ion isolation step to provide high resolving power, with high efficiency.

In step 301, a suitable set of DC and RF trapping voltages are applied to all segments of device 10. These voltages allow ions to enter through entrance segment 11 and to be initially trapped in segments 12-18.

In step 302, the applied voltages are such as to prevent any further ions from entering device 10 whilst allowing the ions initially trapped in segments 12-18 to collide with buffer gas and lose kinetic energy to the buffer gas. As in previous methods, this loss of kinetic energy will cause the trapped ions to accumulate at the position of lowest DC potential, in this case in segment 15. Eventually the ions trapped in segment 15 will reach thermal equilibrium with the buffer gas in the segment.

In step 303 the applied voltages are effective to isolate precursor ions of a desired n/z range in segment 15 by ejecting unwanted ions. This isolation may be carried out using broadband dipole excitation which is described in more detail more with reference to FIGS. 15 and 16 below.

In step 304 the applied voltages are effective to trap the precursor ions selected (or isolated) in step 303 in segment 15. Again, the precursor ions will collide with buffer gas to lose kinetic energy and will accumulate at the position of lowest DC potential within segment 15. As in step 302, eventually thermal equilibrium will be reached between the buffer gas and the precursor ions.

In step 305 the applied voltages are effective to fragment the cooled precursor ions in segment 15 by applying a single frequency dipole excitation to the segment, effective to cause resonant Collision Induced Dissociation (CID). The voltages necessary to cause such fragmentation will be described in detail below, with reference to FIGS. 17 to 20.

In step 306 the applied voltages are effective to cause the fragmented ions trapped in segment 15 to be transferred between segments 15-17 and to be trapped within these segments. As described with reference to other steps, the trapped ions will collide with the buffer gas. They will lose kinetic energy and will eventually accumulate at the position of lowest axial DC potential. In this case, they will accumulate in segment 17, the extraction segment.

Step 307 is similar to step 204 of FIG. 13 and step 104 of FIG. 1, the applied voltages D causing axial confinement of the ions in the extraction segment 17. This reduces the emittance of the ion cloud in segment 17.

In step 308 the applied voltages are effective to compress the ion cloud in extraction segment 17 so that it occupies a reduced area in "velocity-position" phase space in directions transverse to the longitudinal axis of the ion trap. This process, referred to as "burst compression", will be described in more detail below with reference to FIGS. 21(*a*)-21(*c*).

In step 309 an extraction voltage is applied to the extraction segment 17.

In all of steps 302-309 the voltage applied to entrance segment 11 is such as to prevent further sample ions entering the device 10 whilst the steps are being performed. Steps 301-309 can be cycled through continuously.

This method of 'tandem in time' analysis provides high resolving power with high efficiency. However, it is a relatively slow method and is limited to approximately 5-10 $MS^2$ spectrum/sec.

As mentioned above, a brief explanation of broadband dipole excitation is now provided.

Figure 15:
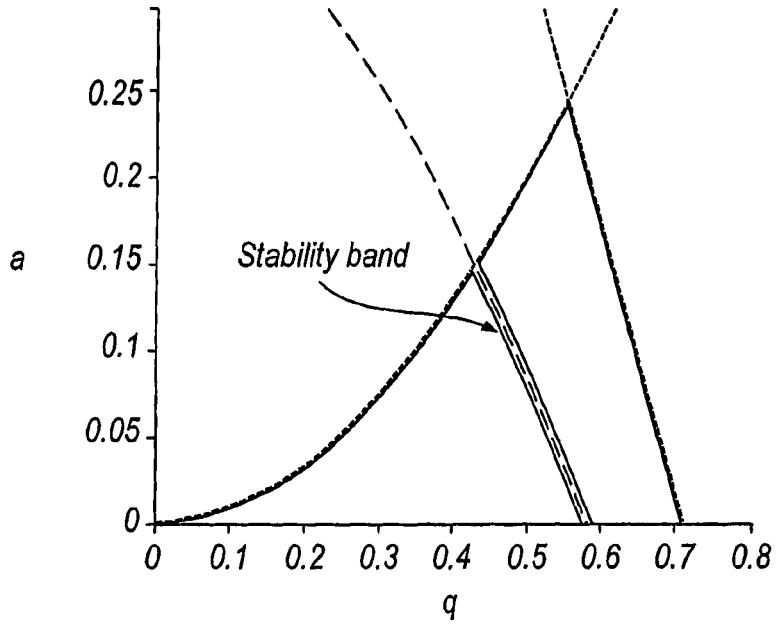
FIG. 15 shows an a-q diagram. The unshaded region within the boundaries corresponds to ions of a selected m/z ratio to be isolated.

FIG. 15 shows an a-q stability diagram. These are well known in the art. Using broadband excitation it is possible to eject all of the ions within the shaded region of the diagram, and to isolate the ions of a particular m/z ratio within the unshaded region. This unshaded region is the stability band and contains the desired precursor ions.

Figure 16:
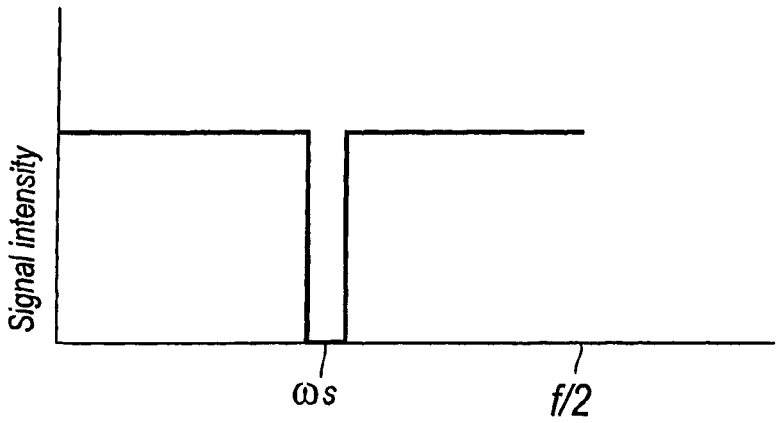
FIG. 16 shows a frequency spectrum view of a broadband signal necessary to isolate the ions in the unshaded region of FIG. 15.

FIG. 16 shows the frequency spectrum of a broadband signal applied to segment 15 of device 10 to isolate the desired precursor ions. The actual signal to be applied to segment 15 can be derived from a reverse Fourier Transform of the frequency spectrum. Typically the broadband signal is applied for several milliseconds and is effective to eject unwanted ions from the segment and isolate the desired precursor ions in the segment.

FIGS. 17 to 20 are used to illustrate single frequency dipole excitation which is used to cause CID (Collision Induced Dissociation). The single frequency dipole excitation is applied to segment(s) of the device 10 to excite (or eject) ions of a particular m/z range.

Figure 17:
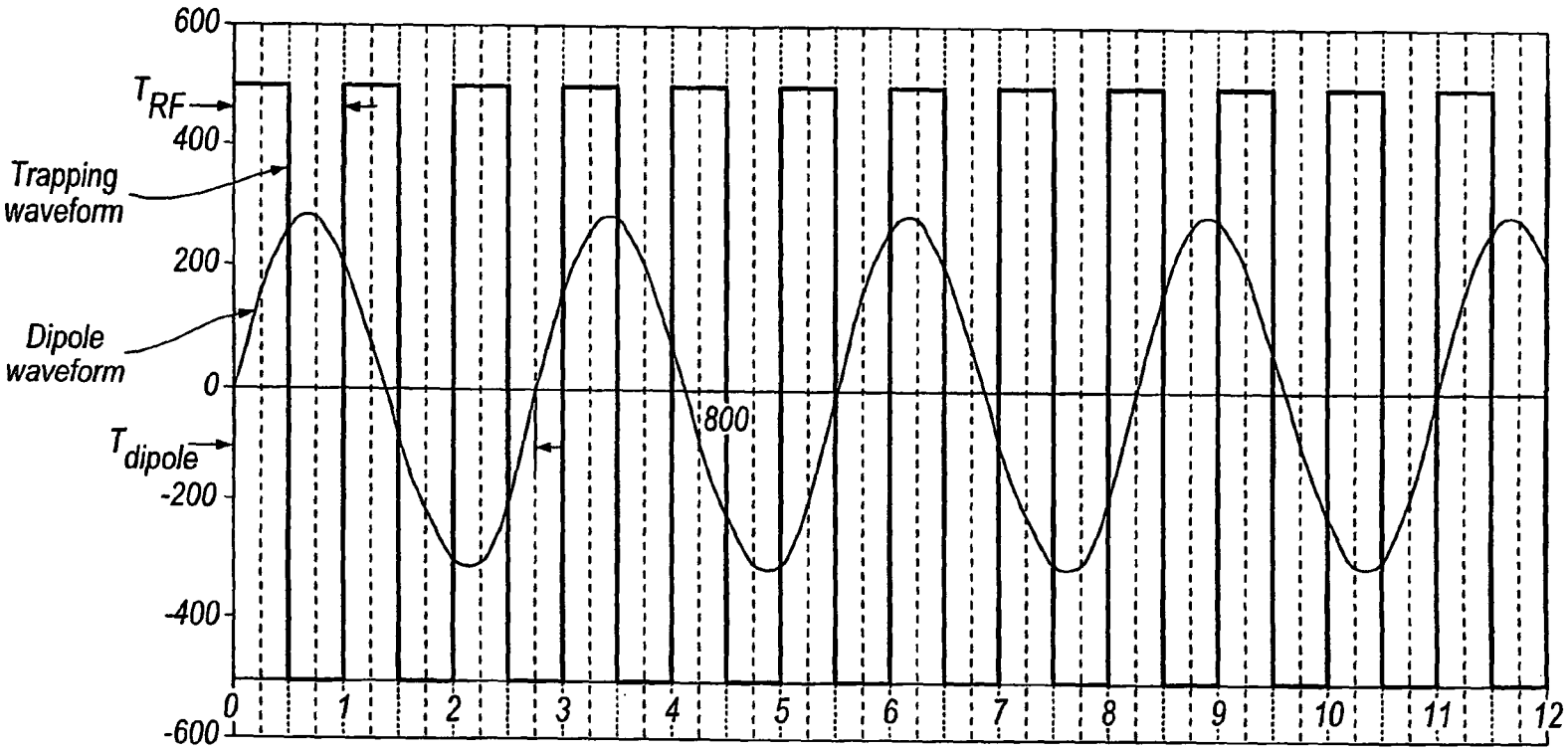
FIG. 17 shows a schematic trapping waveform with associated dipole signal applied to a segment of the device to cause resonance excitation at a desired q value of ions in the segment.

FIG. 17 shows the RF trapping waveform ($T_{RF}$) and the dipole waveform separately as they are applied to segment(s) of device 10. The effect of the dipole waveform is to excite and/or eject ions of a particular m/z ratio within the segment to which the waveforms are applied. Preferably, the period of the dipole waveform is chosen to be an integral number of quarter waves of the RF trapping waveform. This is shown in FIG. 17, where the two waveforms have a frequency ratio of 2.75, and the waveforms come back into phase after exactly 11 cycles of RF trapping waveform and 4 cycles of the dipole waveform.

Figure 18:
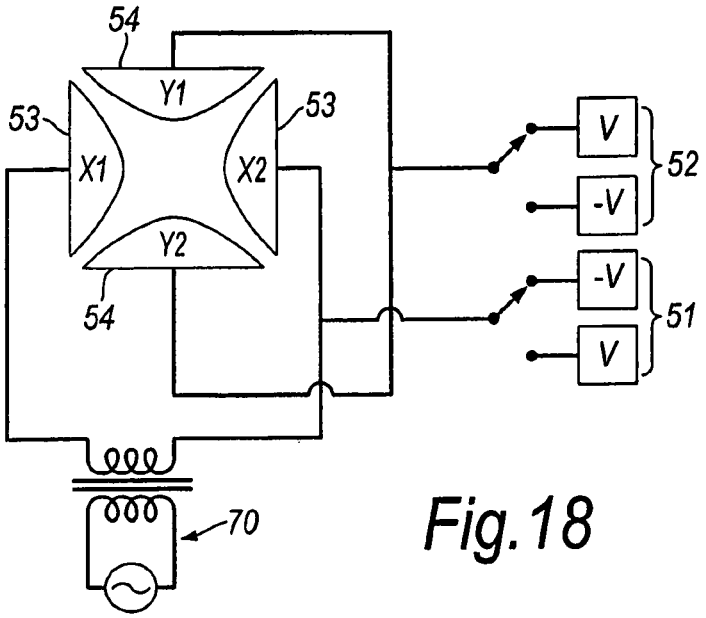
FIG. 18 shows a switching arrangement for applying the trapping waveform with associated dipole signal.

FIG. 18 illustrates a preferred digital switching arrangement showing how the RF and dipole waveforms are supplied to segment(s) of the device 10. In this example, the dipole waveform (generated by sinusoidal generator 70) and trapping waveform are superimposed and applied to the X rods 53 of the segment. Typically, this is done using an isolation transformer, with secondary windings coiled in a bi-filar configuration.

Figure 19:
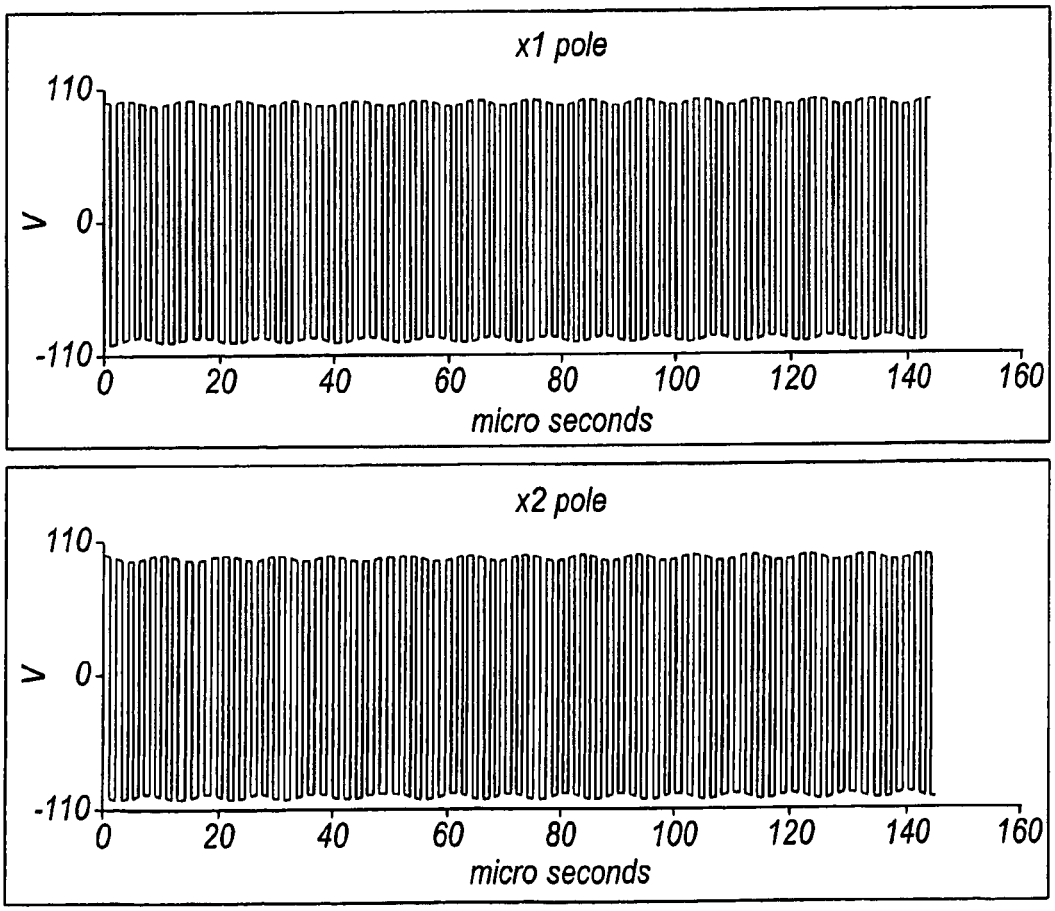
FIG. 19 shows a single frequency dipole superimposed upon the RF trapping waveform as applied to a segment of the device.

FIG. 19 shows the actual form of the superimposed voltage, (trapping waveform and dipole excitation) as it is applied to the X rods 53 of the segment waveform using the switching arrangement of FIG. 18.

The ratio between the frequency of the RF waveform and the dipole waveform determines the β value at which ions will resonate in response to the applied voltage, according to the expression:

$$\beta = \frac{2w_s}{f}, \tag{7}$$

where f is the frequency of the RF waveform and $w_s$ is the frequency of the dipole waveform. The frequencies of the two waveforms can be scanned such that β is maintained at a constant value to scan the m/z value at which ions are excited. This will excite ions in a specific m/z range. In the third mode of operation this will be the m/z range of the precursor ions already contained in segment 15 of device 10.

Figure 20:
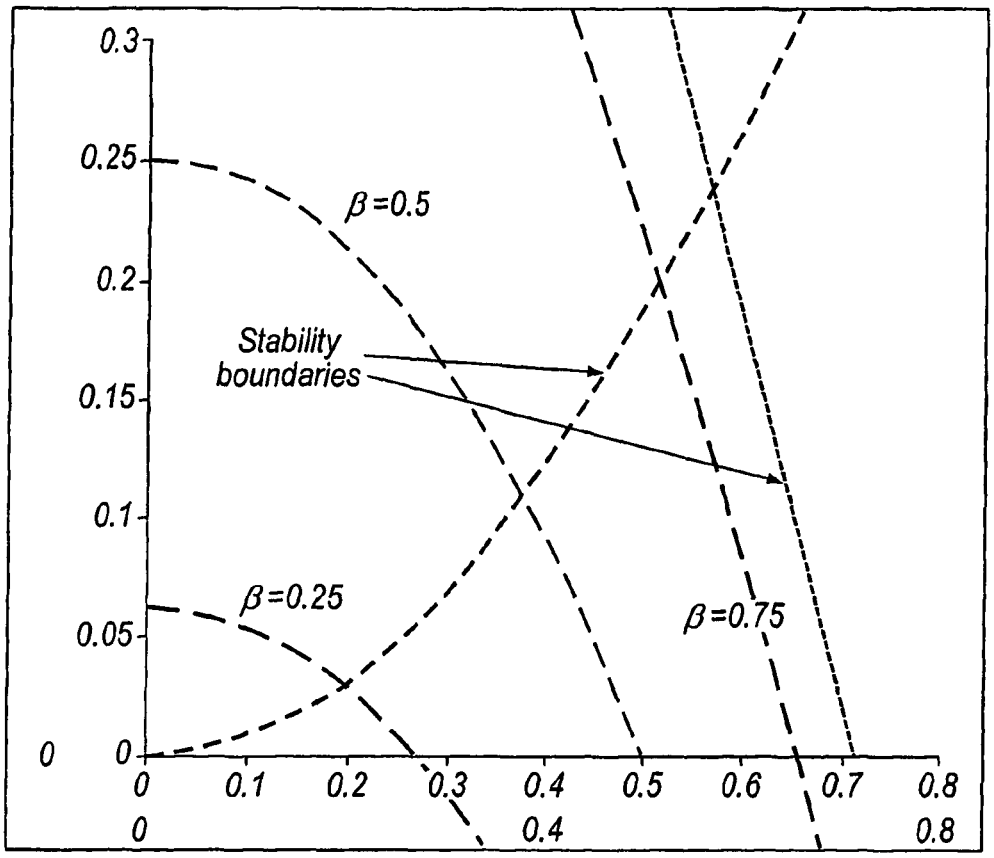
FIG. 20 shows a further a-q diagram used for illustrating the single frequency dipole excitation process.

FIG. 20 shows a second a-q diagram where the stability region (contained within the dotted lines) is intersected by three different β lines; β=0.25, 0.5 and 0.75. These lines intersect the q axis at values of 0.2692, 0.5 and 0.65677 respectively. When β is maintained at a constant value (as described above) all ions in the desired m/z range will be ejected at the same value of q.

For example, using the waveforms as shown in FIG. 17, the frequency ratio is 2.75 and as the frequencies are scanned, ions of increasing m/z values will be ejected/excited with a q value of 0.64639.

An applied dipole excitation causes the precursor ions in the segment to which the signal is applied to oscillate. By controlling the amplitude, and pressure and duration of the applied dipole signal ions may be made to undergo CID without ejecting the ions from the segment.

Figure 21A:
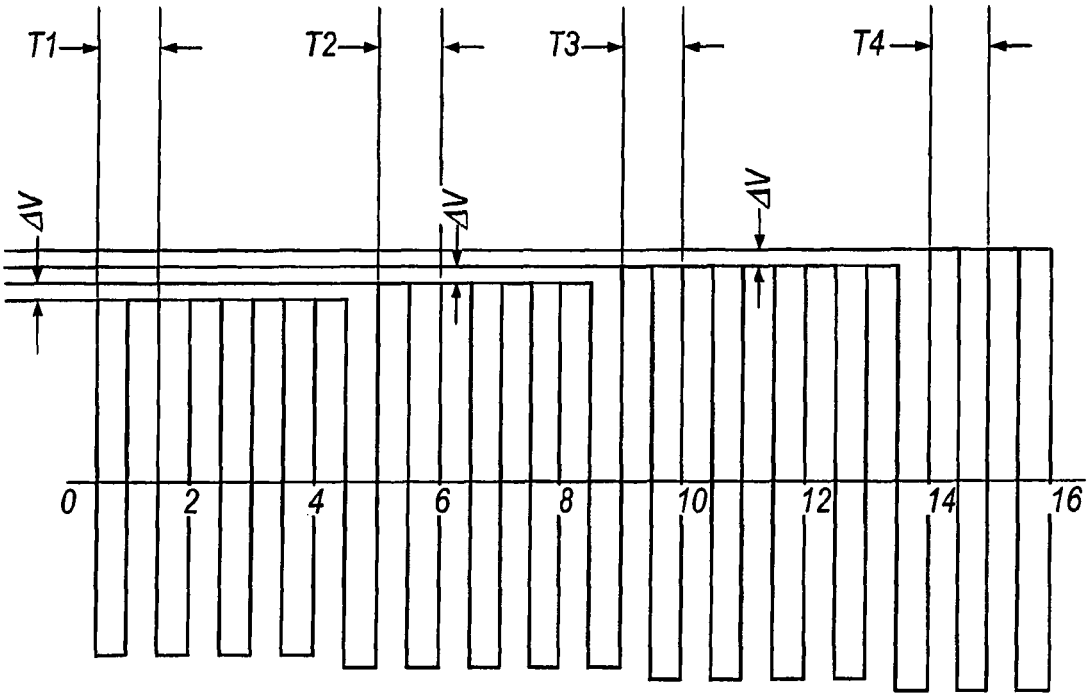
FIG. 21(*a*) shows the trapping waveform as applied to the extraction segment during the burst compression process.
Figure 21B:
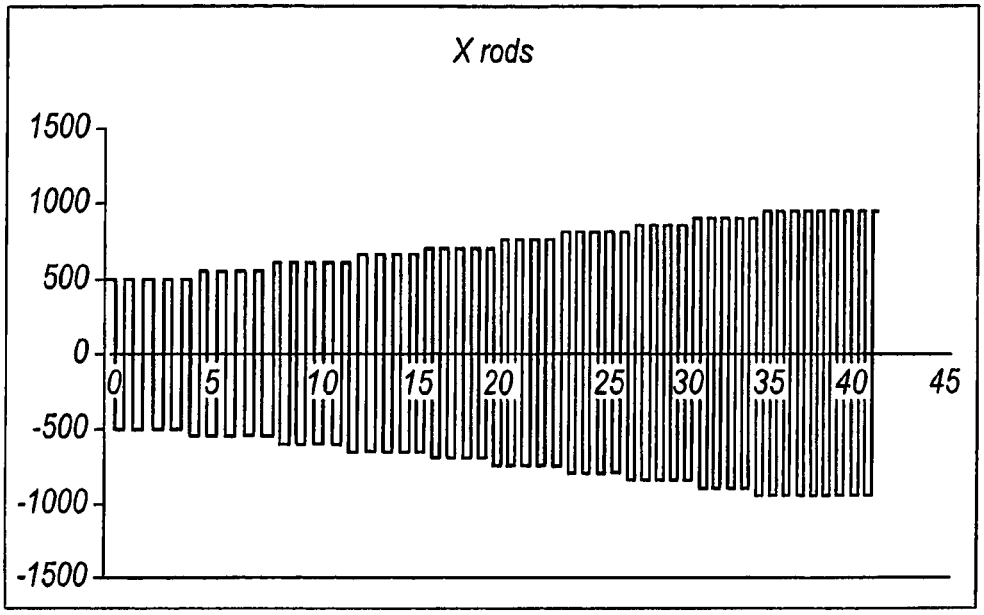
Figure 21C:
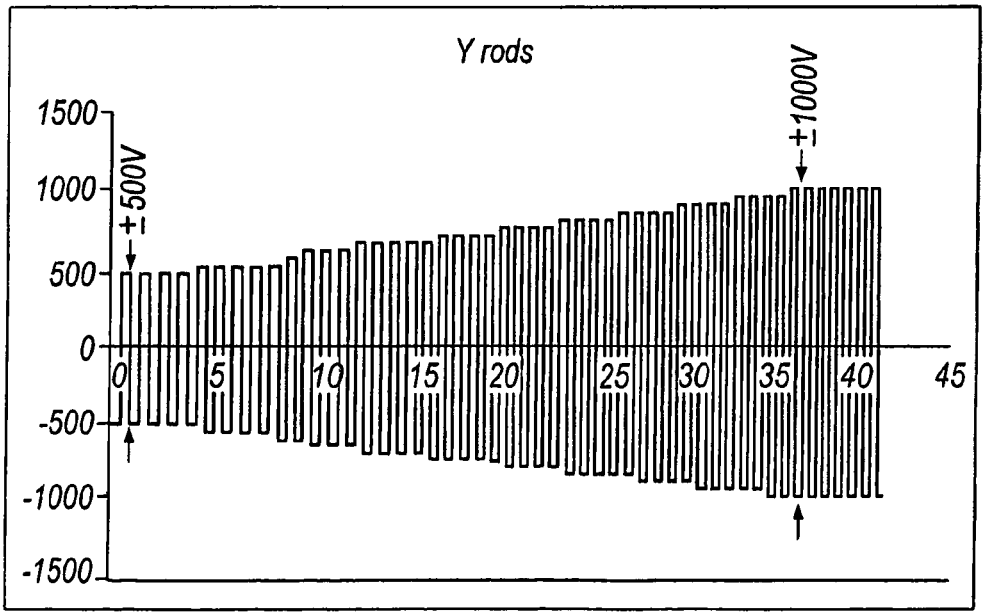

The voltages applied to segment 17 to cause the 'burst' compression will now be described with reference to FIGS. 21(*a*)-21(*c*).

As shown in these Figures, the amplitude V of the digital trapping waveform voltage is momentarily increased, thereby deepening the psuedopotential well created by the trapping waveform. This has the effect of reducing the physical size of the ion cloud in directions transverse to the longitudinal axis, including the extraction direction. More specifically, the physical size of the ion cloud is expressed as a standard deviation, $\sigma_m$ given by:

$$\sigma_m := r_o\sqrt{\frac{K_B T}{2D}}, \tag{8}$$

where T is the ion cloud temperature, $r_o$ is the radial dimension of the segment and D is the amplitude of the effective trapping potential given by:

$$D=0.412Vqq_o, \tag{9}$$

where $q_o$ is the unit charge, q is the Mathieu parameter and V is the amplitude of the trapping voltage assumed to have a square waveform with a 50% duty cycle. Thus, it can be seen that $\sigma_m$, is reduced by increasing amplitude V. This reduction in $\sigma_m$ gives rise to a reduced energy spread of ions in the ion cloud when the extraction voltage is applied to the extraction segment, giving a reduction of ΔT, and so improved resolving power.

Since:

$$q = \frac{4\gamma V}{m r_o^2 \Omega}, \tag{10}$$

the trapping frequency Ω must be increased in proportion to $\sqrt{V}$ to maintain a given range of mass-to-charge ratio of ions in the extraction segment 17.

As shown in the Figures, the magnitude of the trapping voltage is increased gradually in a series of steps. This prevents re-introduction of energy to a previously cooled ion cloud. As already explained, the frequency and voltage should be increased together (see ΔV and corresponding T1-T4 in FIG. 21(*a*)), so as to ensure that q is not changed. For example, if the voltage is increased in a series of equally sized steps then the frequency should be increased according to the square root of the increase in the voltage. Using a digital waveform it is possible to increase the magnitude of the trapping waveform in one abrupt step, with no intermediate steps. However, this approach can result in ion loss, particularly at the highest/lowest values within an m/z range.

Therefore, the stepped approach described above is preferred. As already described the burst compression technique has the beneficial effect that it reduces emittance of the ion cloud when it is ejected from the extraction segment of device 10, improving the overall performance of the ToF mass spectrometer.

Figure 22:
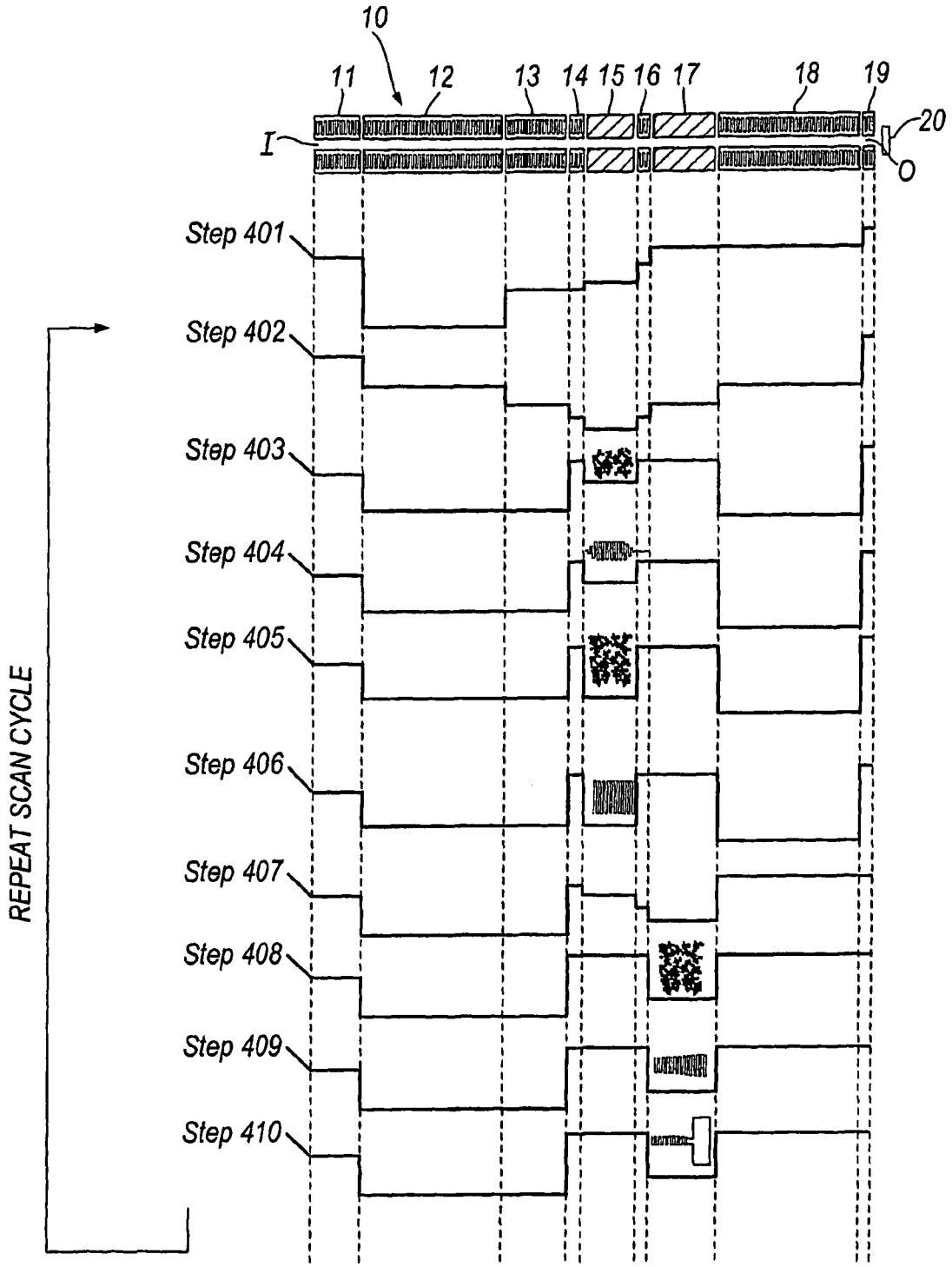
FIG. 22 illustrates DC bias voltage applied to each segment of the segmented device of FIG. 2 during each stage of a complete cycle of an MS/MS experiment in a fourth mode of operation of the apparatus.

FIG. 22 shows a fourth mode of operation of the device. This mode of operation is an MS/MS mode similar to the third mode of operation described with respect to FIG. 14, but this mode also allows ions to be trapped in segments 2 and 3, whilst ions are accumulated and/or processed in segments 15-18.

The DC voltages applied in step 401 are similar to the voltages applied in step 201 of FIG. 13, and allows ions to be initially confined in segments 12 to 16, and subsequently to accumulate in the segment of lowest axial DC potential, due to loss of kinetic energy through collision with buffer gas. In this step the segment of lowest axial potential is segment 12.

The DC voltages applied in step 402 are similar to the voltages applied in step 202 of FIG. 13. The applied voltages allow the ions accumulated in segment 12 during step 401 to be transferred to segments 13-18 whilst continuing to allow new sample ions entering the device 10 to be trapped in segment 12. The ions in segments 13 to 18 lose kinetic energy through collision with buffer gas and eventually are trapped in the segment of lowest axial potential, segment 15.

In step 403 the applied voltages continue to trap ions entering device 10 in segments 12 and 13 (since these segments are at the same axial potential), whilst causing the ions in segment 15 to be axially confined within the central portion of the segment. Eventually the axially confined ions in segment 15 will reach thermal equilibrium with the buffer gas.

In step 404 the applied voltages are effective to continue to allow sample ions to enter device 10 and be stored in segments 12 and 13, whilst providing broadband isolation of the ions in segment 15 to isolate precursor ions in a desired m/z range. This precursor isolation process was described above with reference to FIGS. 15 and 16.

In step 405 the applied voltages are effective to continue to allow sample ions to enter device 10 and be stored in segments 12 and 13, whilst also cooling the isolated precursor ions in segment 15. Eventually the precursor ions will be sufficiently cooled (through collisions) to be in thermal equilibrium with the buffer gas.

In step 406, the voltages allow ions to continue to enter device 10 and be trapped in segments 12 and 13. The voltage applied to segment 15 includes a single frequency dipole excitation (as described above). This causes the precursor ions to oscillate with an amplitude and for a duration that causes CID. The fragmented ions produced by the dissociation are then trapped in segment 15.

At this stage, steps 403 to 406 may be repeated (one or more times) to provide an $MS^n$ capability.

In step 407 the voltages on segments 11, 12 and 13 allow ions to continue to enter the device and be trapped in segments 12 and 13. The voltages on the remaining segments transfer ions from segment 15 into segments 15-17. The ions in segments 15-17 will lose kinetic energy through collision with the buffer gas and will eventually accumulate in the region of lowest axial DC potential, in this case in segment 17.

In step 408 the applied voltages allow ions to continue to enter device 10 and be trapped in segments 12 and 13, whilst causing ions in segment 17 to be axially confined within the central portion of segment 17. Eventually the axially confined ions will reach thermal equilibrium with the buffer gas. This step is very similar to step 403, the only difference is in the segment where the ions to be analysed are stored.

In step 409 the applied voltages allow ions to continue to enter device 10 and be trapped in segments 12 and 13. The applied voltages are also effective to compress the fragmented ions in segment 17 in an extraction direction using the burst compression technique as described above.

In step 410 the applied voltage allows ions to continue to enter device 10 and be trapped in segments 12 and 13, and cooled ions in segment 17 to be extracted for analysis in a Time-of-Flight Analyser.

Figure 23:
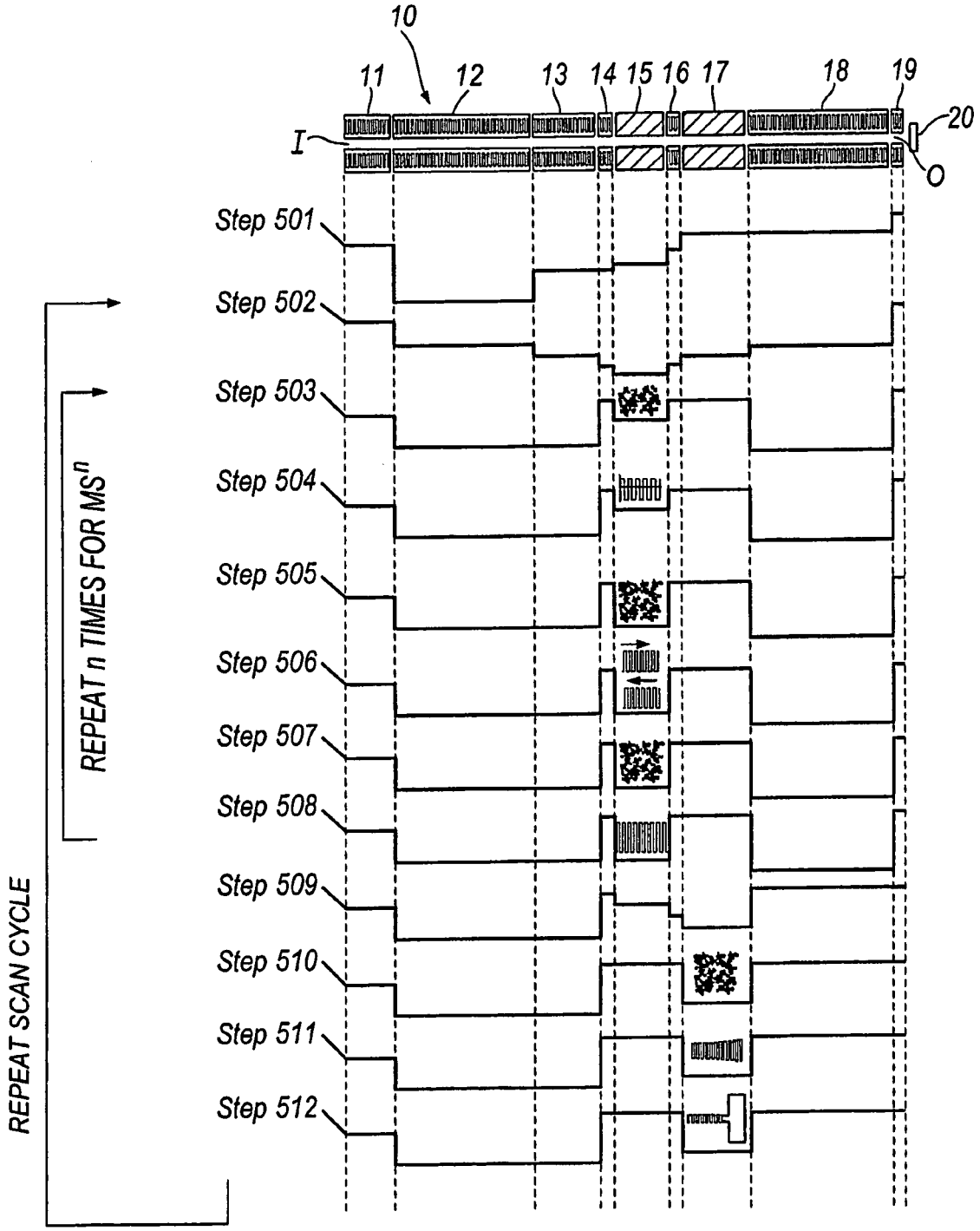
FIG. 23 illustrates DC bias voltage applied to each segment of the segmented device of FIG. 2 during each stage of a complete cycle of an MS/MS experiment in a fifth mode of operation of the apparatus.

FIG. 23 shows a fifth mode of operation of the device.

This mode of operation provides precursor ion isolation with a 100% duty cycle and gives high resolving power with high efficiency. However, it is a relatively slow and is limited to 5-10 MS/second.

In steps 501, 502 and 503 the applied voltages correspond to the voltages applied in steps 401, 402 and 403 respectively of FIG. 22 described above.

In step 504 the applied voltages are effective to continue to allow sample ions to enter device 10 and be stored in segments 12 and 13, whilst providing a voltage to segment 15 effective to isolate ions of a particular m/z range in segment 15. This isolation voltage will be described in more detail below with reference to FIGS. 24-26. The isolation voltage is effective to isolate precursor ions in a desired m/z ratio in segment 15, whilst ejecting all other ions from segment 15.

In step 505 the applied voltage corresponds to the voltage applied in step 405 of FIG. 22 described above.

In step 506 the applied voltages are effective to continue to allow sample ions to enter device 10 and be stored in segments 12 and 13, whilst applying a frequency scan of a single frequency dipole excitation and trapping voltage to segment 15 to scan up to a desired m/z value at the lower limit of a selected range (ejecting ions below this value), then scanning in the reverse direction to eject ions above the desired m/z range, thus providing precursor isolation in a desired m/z range. This frequency scan procedure will be described in more detail below with reference to FIG. 27.

In steps 507-512 the applied voltages correspond to and have the same effect as the voltages applied in steps 405-410 respectively of FIG. 22 described above.

Figure 24:
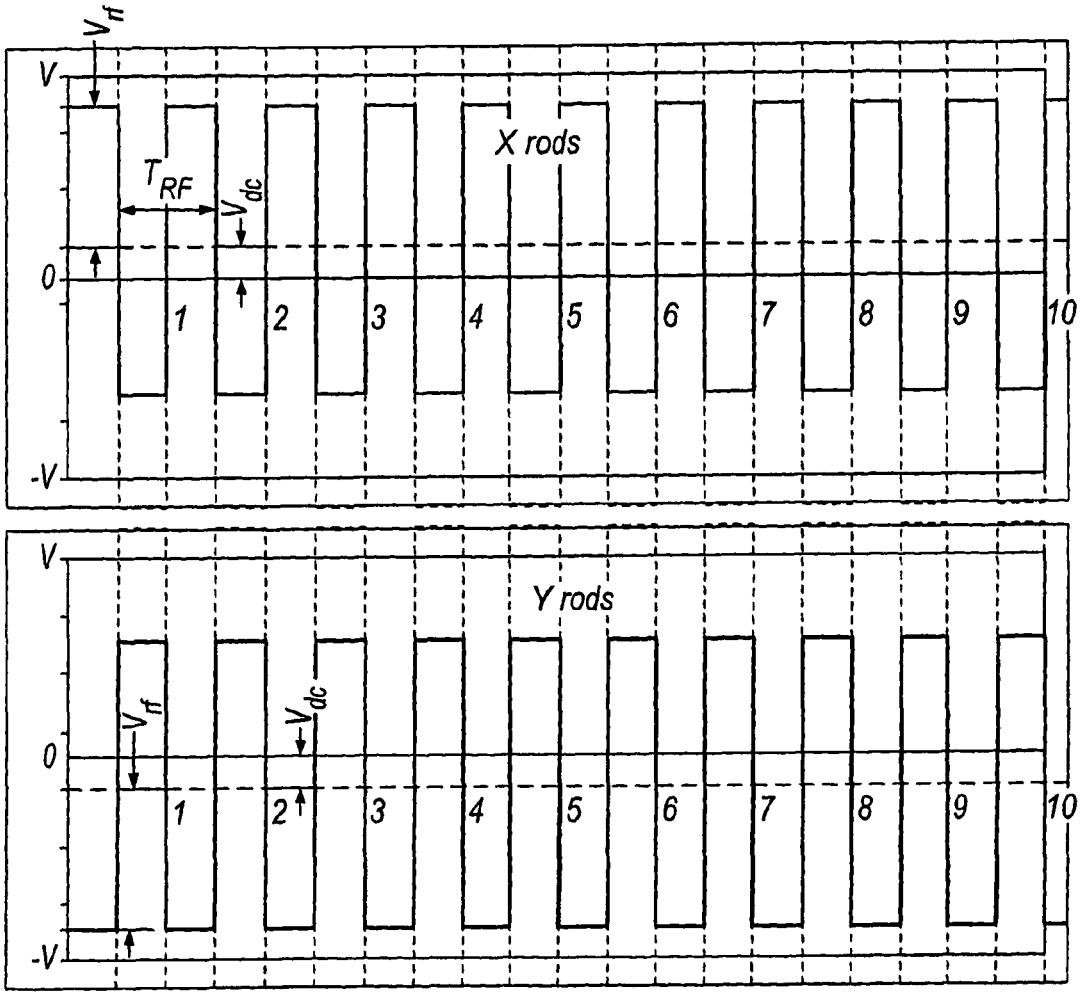
FIG. 24 shows an RF trapping waveform with DC offset applied between the X and Y rods to allow isolation/filtering of ions in a segment.

FIG. 24 shows a typical waveform that maybe applied to the X and Y rods of segment 15 of device 10 to allow isolation of sample ions within a particular m/z ratio within segment 15, in step 504 of the fifth mode of operation described above. Like the waveform shown in FIG. 9, a DC offset voltage is applied together with the RF trapping waveform. However, in this case, the applied DC offset is positive on the X rods, and negative on the Y rods, whereas in FIG. 9 a positive DC offset was applied to the X and Y rods. Typically, the DC offset waveform of FIG. 24 is applied using a switching circuit like that shown in FIG. 7, although other types of switching arrangement may, of course, be used to provide the waveform.

Figure 25:
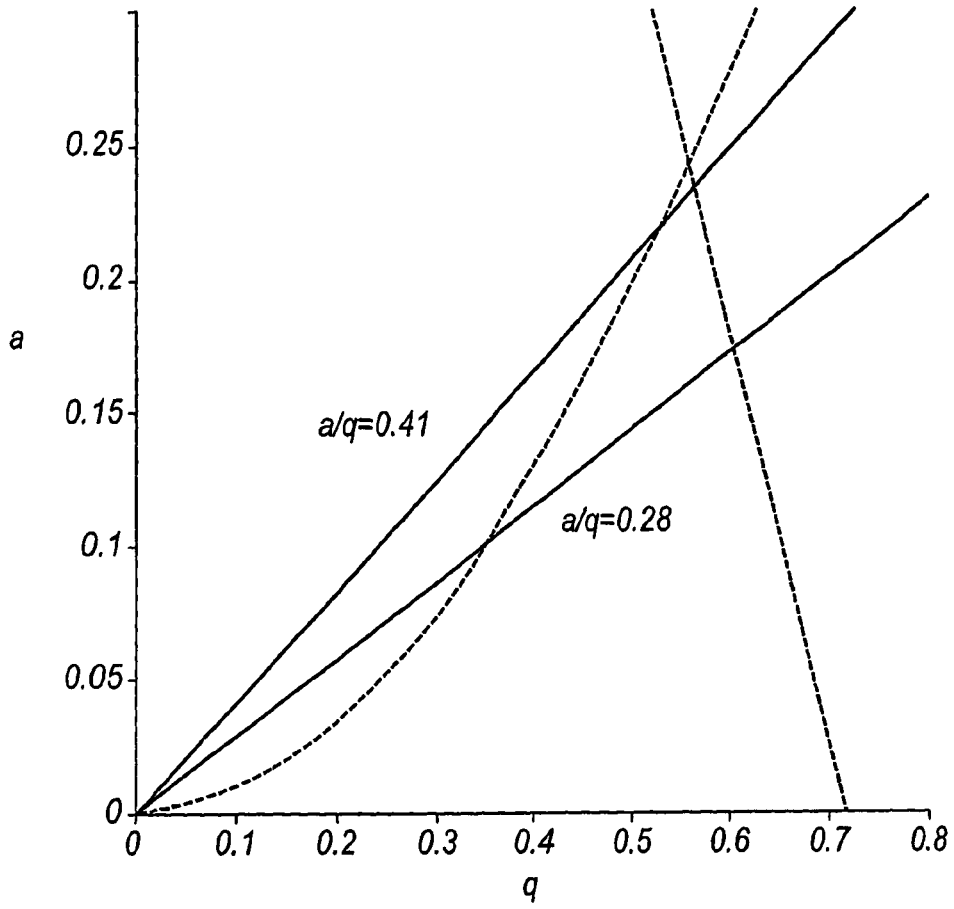
FIG. 25 shows a further a-q stability diagram used to illustrate mass selective filtering of ions.

Using the waveform of FIG. 24, ions in a particular m/z range can be isolated within segment 15. How this can be achieved is illustrated with reference to FIG. 25. The magnitude of the applied DC offset voltage determines the slope of the scan line and thus the point of intersections with the boundaries of the a-q diagram. Scan lines of a/q=0.41 and a/q=0.28 are shown in the example of FIG. 25. Selecting the magnitude of the applied DC voltage (and hence the value of a/q) allows the resolving power of the to segment to be determined.

Ions in segment 15 within a desired m/z range can be isolated using the DC offset voltage in the following two ways. Firstly, the applied DC voltage is such as to move ions in the desired m/z range to the tip of the a-q stability diagram (i.e in the area bounded by the stability boundaries and above the line a/q=0.41). All other unwanted ions now reside outside the stability region and are lost from segment 15, e.g. by ejection or collision with the rods.

Alternatively, the applied DC voltage moves ions to the region of the a-q diagram bounded by the stability boundaries and above the line a/q=0.28. The RF trapping waveform can then be scanned to lower and higher frequencies to isolate ions in the desired m/z range.

The waveform of FIG. 24 may also be used for mass filtering of ions, where the ions have not yet become trapped within a segment of device 10, but are travelling through a particular segment of the device. When the waveform is applied to produce filtering, only ions at the tip of the a-q stability diagram will pass through the segment, the remaining ions are unstable and will not pass into the adjacent segment. The m/z range of the ions that are able to pass out of the filtering segment is determined by the inclination of the scan line in the a-q diagram. Unlike a conventional quadrupole mass filter the value of the applied DC voltage is independent of the desired m/z range. The desired m/z range is selected according to the frequency for a given RF amplitude.

In step 504 of FIG. 23 the ions that are isolated in segment 15 using the DC offset waveform are retained within segment 15. This is because the voltages applied to segments 14 and 16 on either side of segment 15 are higher (see FIG. 23) and so the isolated ions remain in segment 15, as this is at a lower axial potential than the adjacent segments. Of course, if the applied DC voltage on an adjacent segment is lower than the voltage on the segment where the isolation/filtering has occurred, then the isolated ions can pass out of the segment where they were isolated, into the adjacent segment, and also enter further adjacent segments if the applied voltages are such that the ions will tend to migrate to the segment of lowest axial potential.

Figure 26:
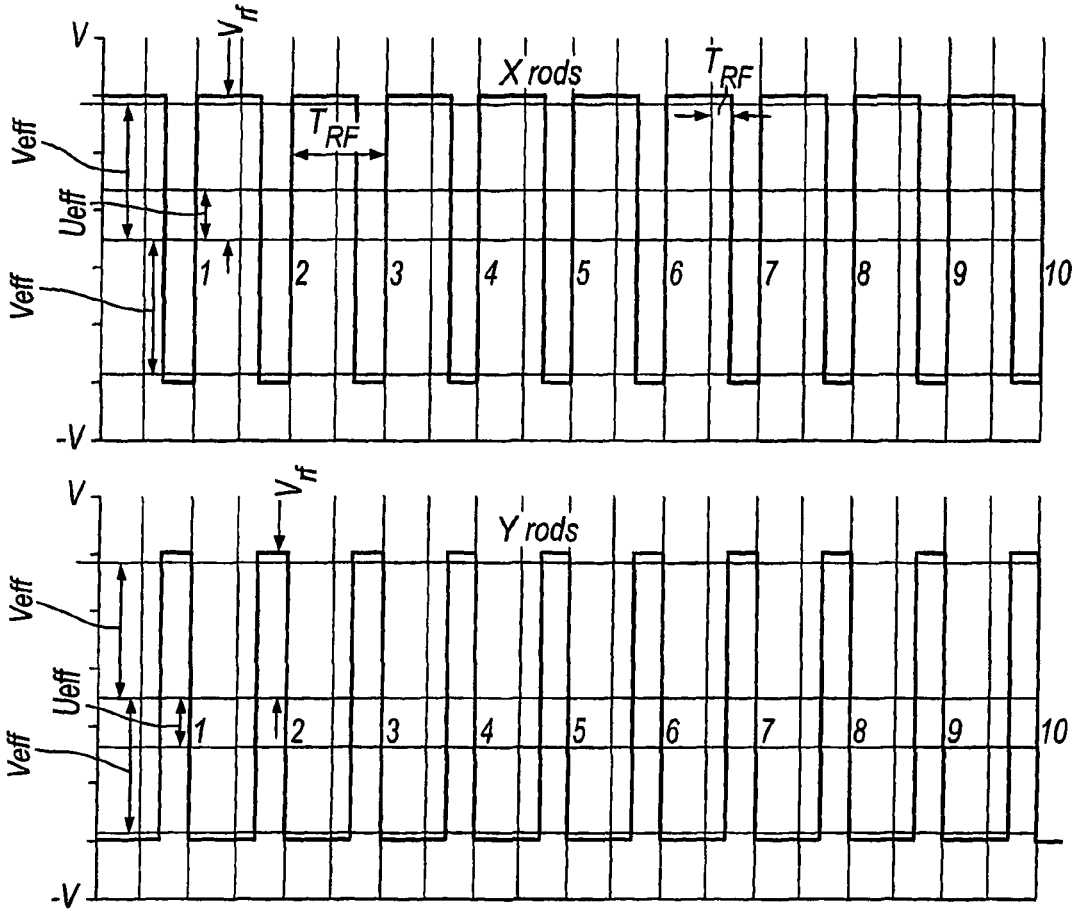
FIG. 26 shows a trapping waveform with a modified duty cycle introducing an effective DC offset between X and Y rods.

There is also an alternative way to introduce a DC offset, rather than using separate DC power supplies as discussed above. This alternative method uses modification of the duty cycle to introduce an effective DC offset between the X and Y rods. A waveform with such a modified duty cycle is shown in FIG. 26. The effective values of the RF and DC components Veff and Ueff respectively are given by.

$$Veff(v, d) = 4v(1-d)d \tag{11}$$

$$Ueff(v, d) = V(2d-1) \tag{12}$$

$$d(T, \Delta Tdc) = 0.5 + \frac{\Delta Tdc}{T} \tag{13}$$

Figure 27:
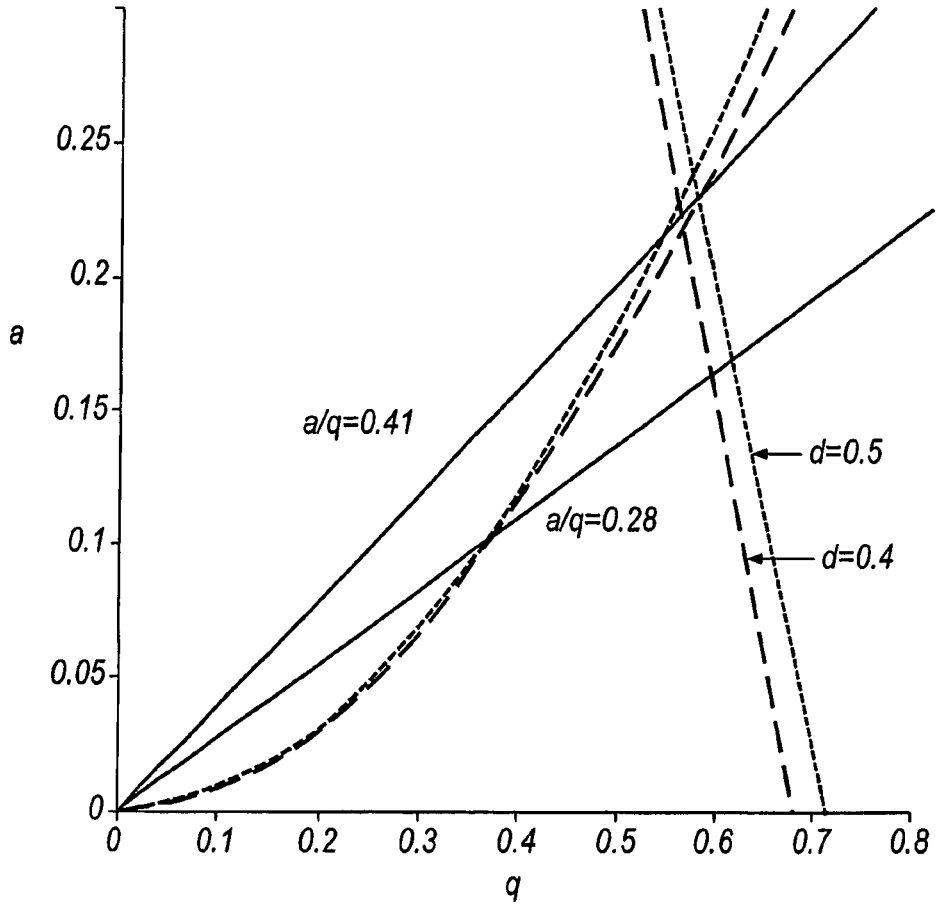
FIG. 27 shows an a-q stability diagram with shifted boundaries reflecting the DC offset of FIG. 26.

If this duty cycle method is used to isolate/filter ions it also has an additional effect on the a-q stability diagram. This is illustrated in FIG. 27. As this Figure shows, as the duty cycle of the periodic trapping waveform is changed, the boundaries of the stability region are shifted. Whilst the duty cycle modification method is relatively easy to implement the additional effects caused by the shift in stability boundaries must be taken into consideration.

Figure 28:
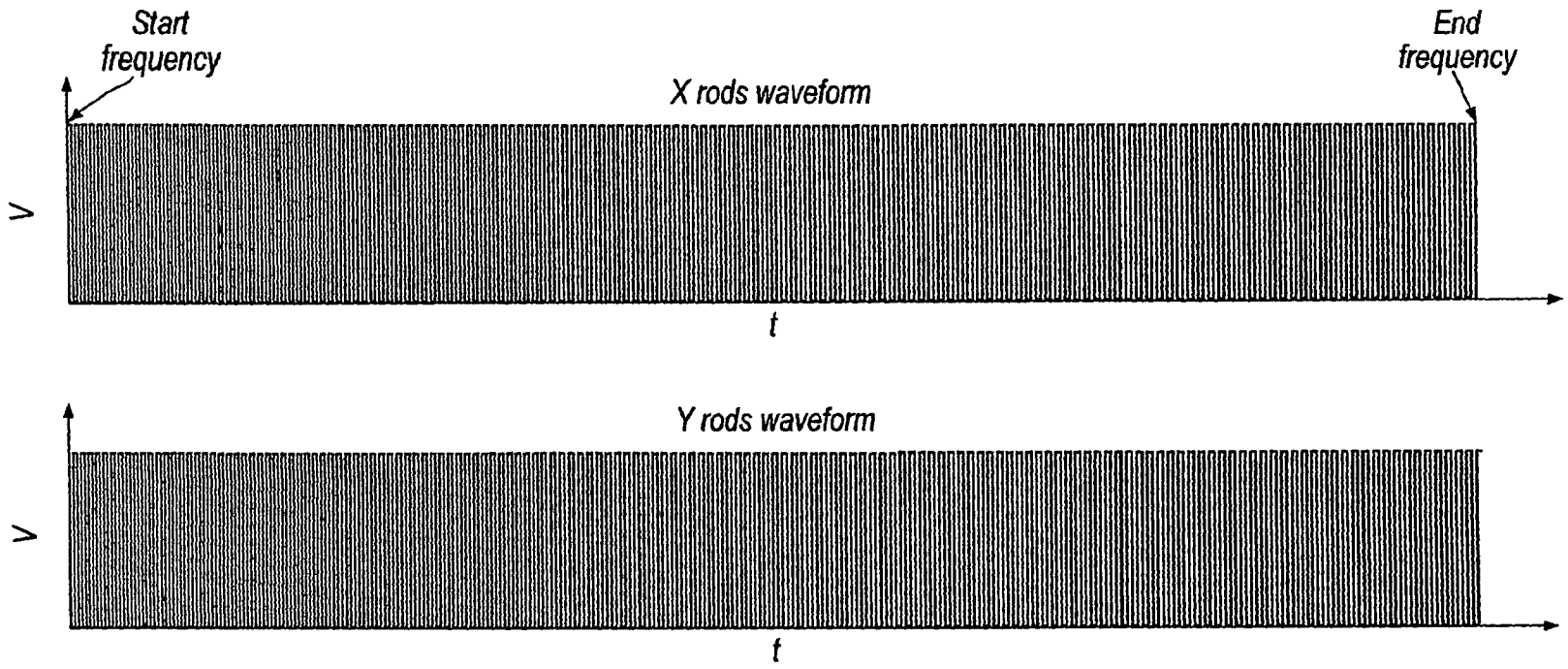
FIG. 28 shows the waveform applied to the X and Y rods of a segment when the frequency of the RF waveform is scanned.

FIG. 28 illustrates the waveforms applied to the X and Y rods of segment 15 during step 506 described above (isolation by forward and reverse frequency scans). As shown in the Figure, the frequency of the RF trapping waveform is scanned, from an initial period $T_{start\text{-}RF}$, and is incremented by a constant amount $\Delta T_{RF}$, after a fixed number of RF cycles, $N_{wave}$, until the final period $T_{end\text{-}RF}$ is reached. In FIG. 28, $T_{start\text{-}RF}$ is 1.29 μs and $T_{end\text{-}RF}$ is 1.82 μs. In this case, the waveform was calculated for 5 steps with $N_{wave}$=23. If the waveform amplitude is 500V this will scan the m/z range for 500 Thompsons (Th) to 1000 Thompsons.

Forward and reverse m/z scans can be carried out using this type of waveform to isolate ions in a narrow m/z range, for example, 0.1 Thompsons.

Figure 29:
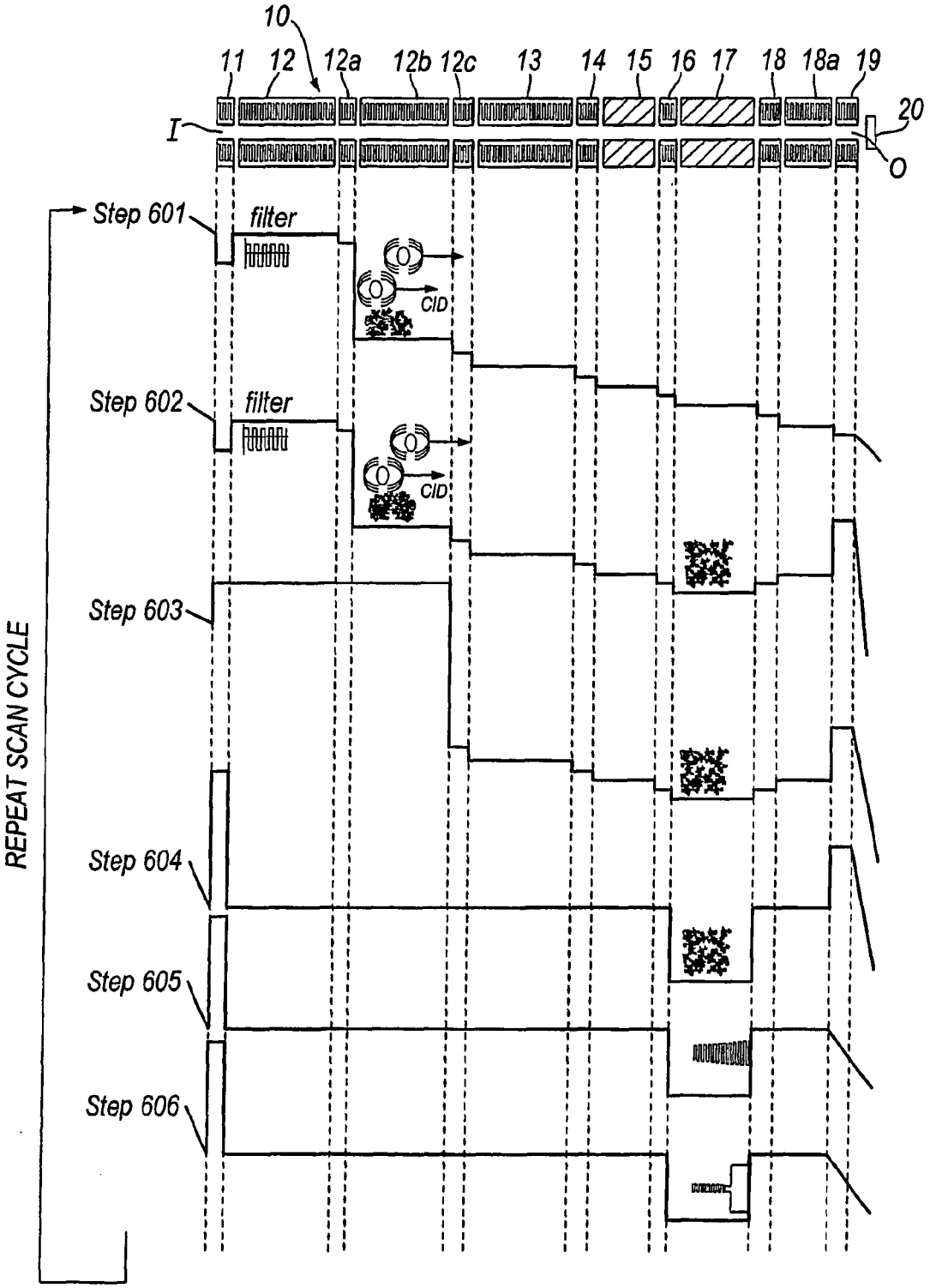
FIG. 29 illustrates DC bias voltage supplied to each segment of the segmented device of FIG. 3 during each stage of a complete cycle of an MS/MS experiment in a sixth mode of operation of the apparatus.

FIG. 29 shows a sixth mode of operation of the device 10. This mode of operation uses the embodiment of device 10 as shown in FIG. 3, with 13 segments. The mode is effective to provide mass selective filtering of the ions as they enter the device 10 and then fragmentation (by CID) of the filtered ions in a further segment of the device. This method provides tandem in space analysis and allows a high number of MS/MS spectra to be acquired per second, typically 50-100 spectra/sec is possible. This method also allows for automatic charge control (similar to that described with reference to the first mode as illustrated in FIG. 4).

In step 601 the applied voltages allow ions to enter device 10. The ions are filtered in segment 12 (filtering as described above) and only precursor ions within a pre-selected m/z range pass out of segment 12, to be accelerated into segment 12*b* which has a lower axial potential. The voltage on segment 12*b* is effective to cause the precursor ions to collide with buffer gas and undergo the CID process described above. Fragment ions are generated as a result of the CID process. The voltages applied to segments 12*c*-19 provide a stepping down of axial potential across segments 12*c*-19. This allows the fragmented ions exiting segment 12*b* to pass through segments 12*c*-19 to be detected by device 20 after they exit segment 19.

In step 602 the voltage applied to segments 11 and 12 is effective to allow ions into device 10 and to filter the ions in segment 12. Only ions within a preselected m/z range pass out of segment 12 into segment 12*b*, which has a lower axial potential. Again the voltage at segment 12*b* is effective to cause CID of the preselected filtered ions in segment 12*b*. The voltages on segments 13-18 are such as to allow ions leaving segment 12*b* to be trapped in segments 13-19. The precise duration of step 602 is determined according to the ion current detected by the detector 20 in step 601. (This is similar to the process as described with reference to steps 102-103 of the first mode of operation).

In step 603 the applied voltages are effective to prevent any further sample ions entering the device 10 and to allow the fragmented ions in segments 13-18*a* to collide with buffer gas in these segments, to lose kinetic energy and eventually to accumulate in the segment of lowest axial DC potential, in this case, in segment 17. Eventually the ions trapped in segment 17 will reach thermal equilibrium with the buffer gas.

In step 604 the applied voltages are effective to prevent further sample ions entering device 10, whilst causing fragmented ions in segment 17 to be axially confined within the central region of segment 17.

In step 605 the applied voltages are effective to prevent further sample ions entering device 10, whilst compressing the fragmented ions in segment 17 in an extraction direction using the burst compression technique described above.

In step 606 the applied voltages prevent further sample ions entering device 10 and allow the cooled ions in segment 17 to be extracted from segment 17 for analysis in a Time-of-Flight Analyser.

Figure 30:
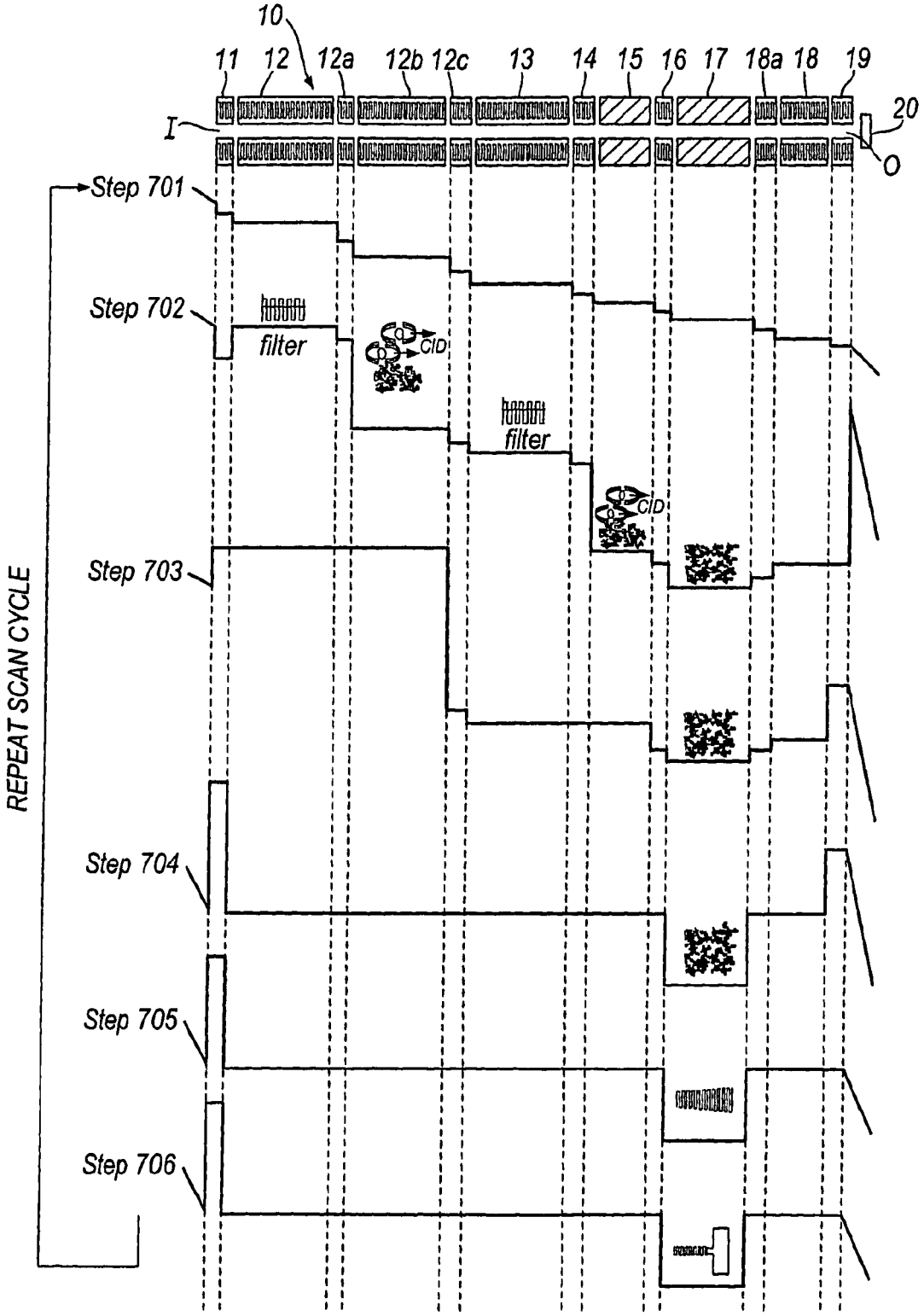
FIG. 30 illustrates DC bias voltage applied to each segment of the segmented device of FIG. 3 during each stage of a complete cycle of an $MS^3$ experiment in a seventh mode of operation of the apparatus.

FIG. 30 shows a seventh mode of operation of device 10. Like the sixth mode described above, this mode also uses the 13 segment device as shown in FIG. 3. This mode provides $MS^3$ analysis by having two precursor ion selection steps as well as CID fragmentation after each filtering step. This is also a 'tandem-in space' analysis method and allows $MS^3$ analysis at a rate of 50-100 $MS^3$ spectra/second, this does not require any reduction in scan rate. Like the sixth mode, this mode also allows for automatic change control.

In step 701 the applied voltages are effective to allow ions entering device 10 to pass from segment 11 to segment 19 (as each segment has a lower axial potential than the preceding segment). Ions exiting segment 19 are detected by detector 20 at the end of device 10.

In step 702 the voltages applied to segments 11 and 12 are effective to allow ions into device 10 and to filter the admitted ions in segment 12. Only ions within a preselected m/z range pass out of segment 12 into segment 12*b*, which has a lower axial potential. The voltage on segment 12*b* is effective to cause CID of the ions in segment 12*b*, generating $MS^2$ ions. The applied voltages cause the fragmented ($MS^2$) ions to pass out of segment 12*b* into segment 13. The voltage on segment 13 is effective to filter ions entering this segment. Only ions in a preselected m/z range pass out of segment 13. The filtered ions pass out of segment 13 and into segment 15, which has a lower axial potential. The voltage on segment 15 is effective to cause CID of the ions entering this segment, resulting in the formation of $MS^3$ ions. The $MS^3$ ions so formed are then trapped in segments 15-18*a*.

In step 703 the applied voltages prevent further ions entering device 10 and allow the $MS^3$ ions in segments 13-18*a* to collide with buffer gas within these segments, and lose kinetic energy and eventually accumulate in the segment of lowest axial DC potential. In this case, in segment 17. Eventually the $MS^3$ ions trapped in segment 17 will reach thermal equilibrium with the buffer gas.

The voltages applied in steps 704-706 correspond to, and have the same effect as the voltages applied in steps 604-606 respectively, of the sixth mode, illustrated in FIG. 28 and described above.

Figure 31:
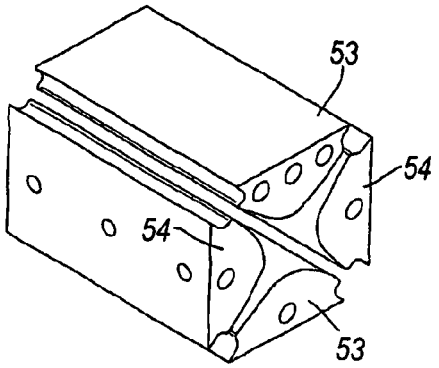
FIG. 31 is an illustration of a segment of the segmented device with hyperbolically-shaped rods.

In all of the seven modes of operation described above the segmented device 10 is preferably a segmented quadrupole device. Such a segment with hyperbolically shaped rods is shown in FIG. 31. The segment has hyperbolically shaped X and Y rods 53 and 54. The X and Y rods are electrodes and they are typically made from a conductive material by precision grinding for example. Alternatively, the electrodes can be formed of electrically insulating material such as ceramic or glass, preferably zero expansion glass with an electrically conductive coating applied to the surface. Achieving the precise alignment required for the segment makes the segment relatively expensive to produce.

The hyperbolically shaped electrodes have surfaces described by the positive and negative roots of the following equations:

$$y(x)=\sqrt{r_o^2+x^2} \tag{14}$$

$$y(x)=\sqrt{x^2-r_o^2} \tag{15}$$

where $r_o$ is the radial dimension of the segment

The quadruple potential within the segment is then given by $$\varnothing(x, y) = \frac{Vo}{2}\frac{x^2 - y^2}{r_o^2} \tag{16}$$

In the normal course of operation of the modes described above, ions may pass between adjacent segments a number of times, and it is desirable to minimise any potential loss of ions as they pass between segments. If the field is not uniform between and across adjacent segments then ions maybe lost in the vicinity of the fringe field (the field in the gap between adjacent segments) as they pass between segments. This is because if the fringe field differs from the quadrupole field within the segments, the axial kinetic energy provided to transfer ions between segments will be transferred into radial kinetic energy of the ions and this will result in ion loss. To prevent this ion loss it is preferable to construct device 10 in a certain way. If the device 10 is made up entirely of segments as illustrated in FIG. 31, the quadrupole field along the entire device will be substantially uniform (and the fringe fields minimised) if $r_o$ for each segment is substantially the same. Alternatively, if $r_o$ is not the same, then the voltage on each segment can be adjusted so that the field between and across adjacent segments is substantially uniform. Again, this will minimise ion loss as ions pass between segments.

Of course, this type of device will be relatively expensive to produce due to the requirement for precise alignment. Alternatively, it is possible to construct one or more segments of device 10 using flat plate electrodes.

Such a segment can be designed and operated so that the field within the segment is substantially quadrupole field and that the field is substantially uniform between adjacent segments, where one or both of the adjacent segments is formed from plate electrodes.

Ding et al (WO 2005/119737) describe an arrangement of 4 conductive surfaces arranged as a square that can be operated to provide a substantially quadrupole field within the square.

Using plate electrodes is preferable because it is easier and less expensive to manufacture precise flat substrates as compared to manufacturing hyperbolically shaped electrodes. The insulating substrate may be a printed circuit board formed on precision ceramics or glass, preferably with a low coefficient of thermal expansion, upon which a metal coating can be applied with an underwired electrical connection made to each electrode 'printed' in this manner.

Figure 32A:
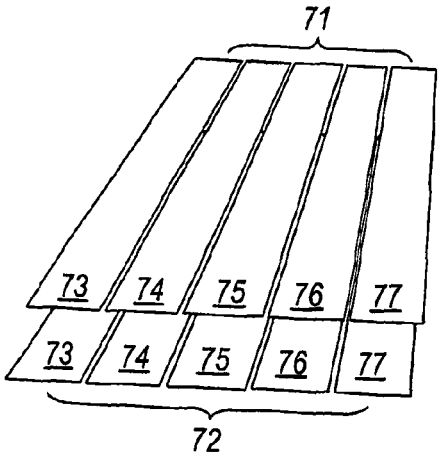
FIGS. 32(*a*) and 32(*b*) illustrate segments of the segmented device formed using flat plate electrodes.
Figure 32B:
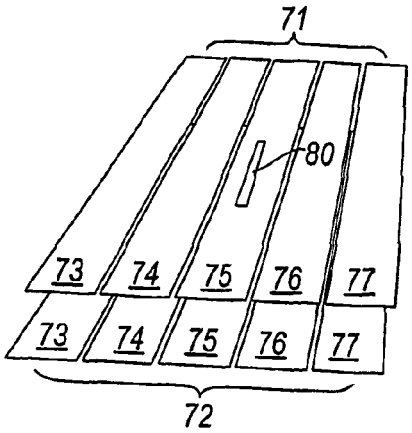

For example, FIGS. 32(*a*) and (*b*) show such a segment formed using plates 71 and 72. In each plate has five 10 mm wide electrodes 73-77. Typically, to substantially reproduce a quadrupole field generated by a segment constructed as in FIG. 31 with $r_o$=5 mm, the separation between the plates should be 10 mm. To achieve the same field strength as in the segment of FIG. 31, the highest applied voltage is 5.6× greater than the voltage applied to the segment of FIG. 31. The actual potential within plates 71, 72 contains other (higher and/or lower order) components as well as a quadrupole component. However the voltages applied to the plate electrodes 73-77 can be controlled to minimise the non-quadrupole components, and in this way the field within the plate is substantially quadrupole and will be sufficiently matched to the field in adjacent segments to minimise ion loss as ions pass between adjacent segments.

In FIG. 32(*b*) there is a slit 80 in the uppermost electrode 75 of plate 71. This is an extraction slit, for when the plates 71, 72 are used as an extraction segment 15 in device 10.

The control circuitry for the plate electrodes 73-77 to provide the DC waveform and RF trapping waveform may be located on the same substrate as the electrodes 73-77. This part of the substrate can be produced by traditional printed circuit board methods, and may be located outside the vacuum region where the electrodes are located, with a vacuum seal formed around the substrate, using vacuum compatible epoxy resin for example. Alternatively, the control circuitry may be provided separately and connected to the plate electrode using flexible PCBs, with a vacuum seal formed around the PCBs.

Figure 33:
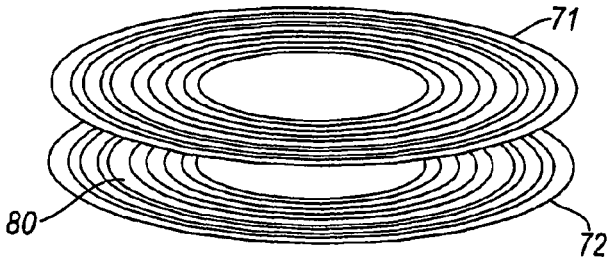
FIG. 33 shows an ion trap formed of circular plate electrodes with the lower electrode having an extraction slot.

The use of flat plates in segments of device 10 has the additional advantage that complex electrode patterns may be readily formed on the plate. For example, FIG. 33 shows a circular pair of plates 71, 72 where the electrodes are formed as a series of concentric circles on the plates. In lower plate 72 there is an extraction slot 80, through which ions can be extracted from the segment for mass analysis.

Figure 34:
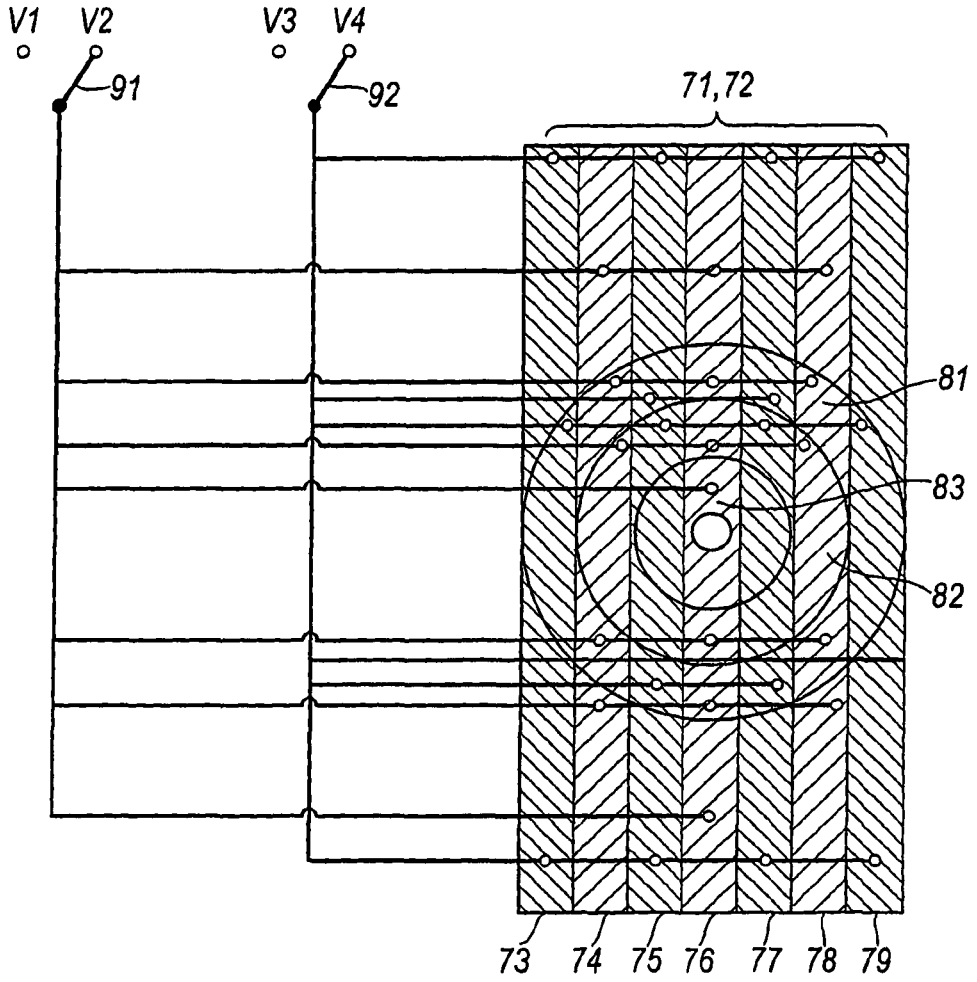
FIG. 34 shows a PCB plate electrode with overlapping electrodes in linear and circular configurations, and the associated switches for activating the electrodes in a linear operating mode.

This arrangement of the electrodes can be used to form an ion cloud within the segment in the form of a toroid. By forming the ion cloud into a toroid the emittance of the cloud is generally reduced, and so this type of electrode arrangement is useful in a segment acting as an ion trap providing ions to a ToF analyser. However, there is a drawback to using this type of electrode arrangement. The drawback is that ions cannot be efficiently introduced into a segment only having this electrode configuration from an external ion source. This drawback can be overcome by using plates with an electrode configuration as shown in FIG. 34.

Figure 35:
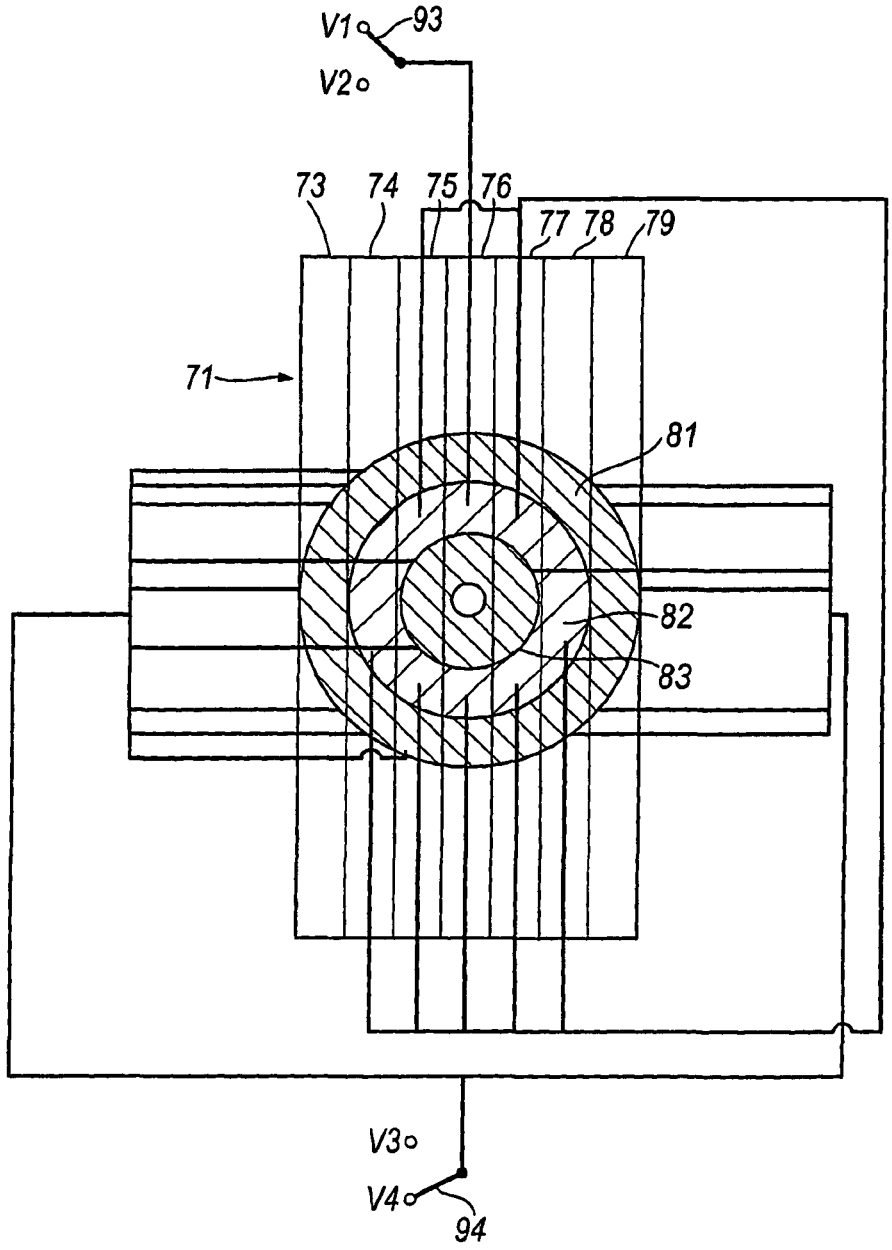
FIG. 35 shows a PCB plate electrode with overlapping electrodes in linear and circular configurations, and the associated switches for activation in circular mode.

In this embodiment, the PCB plate has electrodes that allow linear trapping as well as electrodes that allow toroidal trapping. Electrodes 73-79 are the linear electrodes and electrodes 81-83 are the circular electrodes. The various connections of switches 91, 92 to the electrodes to operate in linear are also illustrated in this figure. The switches to operate in the toroidal mode are switches 93, 94 as shown in FIG. 35. Fast switching between the toroidal/linear modes of FIGS. 34 and 35 can be achieved using the method described in Ding et al; WO 01/29875.

Ions are admitted into a segment formed from the plates 71, 72 and, by controlling the voltage on the linear electrodes the ion cloud is assembled along the longitudinal axis of the segment (as a substantially 1D ion cloud). As discussed above, ions can be efficiently introduced into a segment with this electrode configuration from an external ion source. The linear electrodes 73-79 are then switched off and the circular electrodes 81-83 switched on. This will cause the ion cloud to be transformed from a substantially 1D axially extending cloud to a substantially 2D ion cloud. In this particular case, the circular electrodes 81-83 form the 2D ion cloud in a toroidal shape. Of course, electrodes 81-83 may be formed in alternative 2D arrangements to produce ion clouds of alternative 2D shape.

The toroidally shaped ion cloud has the same charge capacity as the longitudinal ion cloud but will occupy a region of space approximately $\pi\times$ smaller than the longitudinal ion cloud. This will reduce the emittance of the ion cloud.

The diameter of the circular electrodes 81-83 determines the diameter of the toroidal ion cloud that will be produced. For examples, to produce a toroidally shaped ion cloud 5 mm in diameter the width of the circular electrodes should be 2.5 mm and the separation between plates 71 and 72 should be approximately 2.5 mm. After the toroidally shaped cloud is formed an extraction voltage can be applied to extract ions for analysis through exit slot 80. The above mentioned 'delay' and/or "burst compression" techniques may be used before the extraction voltage is applied, and before and/or after the 2D ion cloud is formed.

The extraction voltage that will be applied to a segment with this particular plate/electrode configuration is 4 times less than the extraction voltage that would have to be applied to a segment formed with hyperbolic electrodes and $r_o$=5 mm. This is clearly a desirable reduction and so it is preferable to use a segment formed from plates 71, 72 as an extraction segment 15.

The invention claimed is:

1. A time-of-flight mass spectrometer comprising:
- an ion source for supplying sample ions;
- a segmented linear ion storage device for receiving the sample ions;
- a voltage supply; and
- a time-of-flight mass analyzer, and
- wherein the segmented linear ion storage device comprises:
  - at least a pair of adjacent segments extending along a longitudinal axis of the ion storage device, and
  - an axially-extending region comprising a trapping volume of a group of two or more mutually adjacent segments of the device, and an extraction region that is shorter than the axially-extending region,
- wherein the time-of-flight mass analyzer operates to perform mass analysis of ions ejected from the extraction region
- wherein the voltage supply operates to supply to the device:
  - a trapping voltage including an RF trapping voltage, and
  - an extraction voltage, and
  - wherein the trapping voltage, with the assistance of cooling gas, is effective to trap the sample ions or ions derived from said sample ions in the trapping volume of the axially-extending region and to cause the trapped ions subsequently to become trapped in the extraction region to form an ion cloud,
  - wherein the RF trapping voltage creates a quadrupole trapping field that is substantially uniform along and between the pair of adjacent segments to enable ions to pass between the pair of adjacent segments without substantial loss of ions, and
  - wherein the extraction voltage is effective to cause ejection of the ion cloud from said extraction region in an extraction direction orthogonal to said longitudinal axis of the ion storage device,
- wherein each segment comprises a respective plurality of electrode sections that each have an interior surface,
- wherein, for each electrode section of a first segment of the pair of adjacent segments for which the interior surface is continuous, a respective distance from the longitudinal axis of the ion storage device to a nearest point to the longitudinal axis of the ion storage device along the interior surface of the electrode section is substantially equivalent to a same first distance,
- wherein, for each electrode section of a second segment of the pair of adjacent segments for which the interior surface is continuous, a respective distance from the longitudinal axis of the ion storage device to a nearest point to the longitudinal axis of the ion storage device along the interior surface of the electrode section is substantially equivalent to a same second distance, and
- wherein the first distance for the first segment is different than the second distance for the second segment.

2. A spectrometer as claimed in claim 1 wherein said extraction region comprises a trapping volume of a single segment of the device.

3. A spectrometer as claimed in claim 1 further comprising an ion cloud treatment mechanism for reducing the physical size of, and/or velocity spread of ions in said ion cloud in directions transverse to said longitudinal axis before said extraction voltage is applied.

4. A spectrometer as claimed in claim 3 wherein said ion cloud treatment mechanism is effective to encourage said ion cloud to form on said longitudinal axis before said extraction voltage is applied.

5. A spectrometer as claimed in claim 3 wherein said extraction region comprises a trapping volume of one or more extraction segments of the device and said ion cloud treatment mechanism is arranged to cause said voltage supply to increase a trapping voltage applied to said extraction region.

6. A spectrometer as claimed in claim 5 wherein said increase comprises a succession of stepped abrupt increases.

7. A spectrometer as claimed in claim 3 wherein said extraction region comprises a trapping volume of one or more extraction segments of the device and said ion cloud treatment mechanism is arranged to cause said voltage supply to terminate a trapping voltage applied to said one or more extraction segment and to impose a delay between termination of the trapping voltage and application of the extraction voltage.

8. A spectrometer as claimed in claim 7 wherein said voltage supply applies an intermediate voltage to said one or more extraction segment during said delay.

9. A spectrometer as claimed in claim 3 wherein said trapping voltage is also effective to compress said ion cloud axially within said extraction region.

10. A spectrometer as claimed in claim 2 wherein the single segment of said extraction region is an extraction segment of the device, and wherein said extraction segment includes a first respective electrode section which, when supplied with a first level of said trapping voltage enables ions to form a substantially one-dimensional axially extending ion cloud within the extraction region and a second respective electrode section which, when supplied with a second level of said trapping voltage is effective to transform said substantially one-dimensional axially extending cloud to form a substantially two-dimensional ion cloud in a central plane orthogonal to said extraction direction.

11. A spectrometer as claimed in claim 10 wherein said substantially two-dimensional ion cloud is a toroidally shaped ion cloud.

12. A spectrometer as claimed in claim 10 comprising an ion cloud treatment mechanism for reducing the physical size of, and/or velocity spread of ions in the ion cloud in directions transverse to said longitudinal axis before and/or after said second level of said trapping voltage is applied.

13. A spectrometer as claimed in claim 1 wherein said device has an entrance end and an exit end, an ion detection mechanism located at said exit end, and said voltage supply is arranged to allow sample ions to pass through said device from said entrance end to said exit end for detection by said ion detection mechanism and subsequently to trap ions received within the device from said ion source and prevent further ions from entering the device after a time interval determined by an ion current detected by said ion detection mechanism.

14. A spectrometer as claimed in claim 1 wherein said trapping voltage is effective to trap sample ions in an ion storage region of the device located between an entrance end of the device and the axially-extending region of the device and subsequently to cause ions to pass from said ion storage region into another region of the device whilst simultaneously trapping further sample ions in the ion storage region.

15. A spectrometer as claimed in claim 14 wherein said ion storage region comprises a trapping volume of a single segment of the device.

16. A spectrometer as claimed in claim 14 wherein said another region is said axially extending region.

17. A spectrometer as claimed in claim 14 wherein voltage supplied to said device by said voltage supply causes ions to undergo fragmentation and/or isolation in a region or regions outside said ion storage region whilst simultaneously trapping further sample ions in said ion storage region.

18. A spectrometer as claimed in claim 1 wherein said trapping voltage is effective to trap ions in a fragmentation region of the device, and said voltage supply is arranged to supply fragmentation voltage to the device to cause fragmentation of ions trapped in the fragmentation region.

19. A spectrometer as claimed in claim 18 wherein said fragmentation voltage comprises dipole excitation voltage effective to cause fragmentation of ions in a selected range of mass-to-charge ratio.

20. A spectrometer as claimed in claim 19 wherein said dipole excitation voltage is effective to cause said fragmentation of ions by Collision Induced Dissociation (CID).

21. A spectrometer as claimed in claim 20 wherein said dipole excitation voltage is effective to cause CID by accelerating ions from each of one or more segments of the device into one of more of the segments of the device adjacent to the segment at lower axial potential.

22. A spectrometer as claimed in claim 18 wherein said fragmentation region is separate from said extraction region and said fragmentation voltage creates a quadrupole trapping field substantially within an entire volume of said fragmentation region.

23. A spectrometer as claimed in claim 18 wherein said voltage supply supplies an isolation voltage to the device to isolate for fragmentation precursor ions in a selected range of mass-to-charge ratio.

24. A spectrometer as claimed in claim 23 wherein said isolation voltage is broadband isolation voltage effective to isolate precursor ions in said selected range of mass-to-charge ratio.

25. A spectrometer as claimed in claim 23 wherein said isolation voltage is effective to perform forward and reverse frequency scanning to eject ions to either side of said selected range of mass-to-charge ratio.

26. A spectrometer as claimed in claim 23 wherein said isolation voltage is applied to one or more of the segments of said device that are separate from said extraction region and creates a quadrupole trapping field along and substantially within the entire volume of the one or more segments to which it is applied.

27. A spectrometer as claimed in claim 16 wherein said voltage supply is arranged to cause mass to charge ratio filtering of ions prior to fragmentation and/or isolation of the ions.

28. A spectrometer as claimed in claim 16 wherein said voltage supply is arranged to cause filtering of ions in a first filtering region of the device prior to their fragmentation and to cause further filtering of ions in a second filtering region of the device after their fragmentation.

29. A spectrometer as claimed in claim 28 wherein said first filtering region and said second filtering region are each defined by a single segment of the device.

30. A spectrometer as claimed in claim 28 wherein said fragmentation voltage is effective to cause further fragmentation of ions before they become trapped in said axially extending region.

31. A spectrometer as claimed in claim 28 wherein filtering and fragmentation are carried out in the first filtering region simultaneously with filtering and fragmentation being carried out in the second filtering region of the device.

32. A spectrometer as claimed in claim 18 wherein said fragmentation voltage is effective to cause repeated fragmentation of ions to provide a $MS^n$ capability.

33. A spectrometer as claimed in claim 1 wherein said voltage supply is arranged to cause filtering of ions before they become trapped in said axially-extending region of the device.

34. A spectrometer according to claim 1 wherein said segmented linear ion storage device is a segmented linear quadrupole ion storage device.

35. A spectrometer as claimed in claim 1 wherein said trapping voltage includes a digitally-controlled rectangular waveform voltage.

36. A mass spectrometer as claimed in claim 34 wherein respective electrode sections of at least one segment of the device are flat plate electrodes.

37. A segmented linear ion storage device for use in a time-of-flight mass spectrometer as claimed in claim 1.

38. A time-of-flight mass spectrometer comprising:

an ion source for supplying sample ions;

a segmented linear multipole ion storage device for receiving sample ions supplied by the ion source, the ion storage device comprising a plurality of segments extending along a longitudinal axis of the ion storage device, each segment of the ion storage device comprising a respective plurality of electrode sections that each have an interior surface, the segments of the ion storage device including a pair of adjacent segments;

a voltage supply which supplies to the device;

(i) an RF trapping voltage to create a multipole trapping field which is substantially uniform along and between adjacent segments of said device, to enable ions to pass between adjacent segments without substantial loss of ions, (ii) a DC trapping voltage, which, with the assistance of cooling gas, is effective to trap sample ions, or ions derived from sample ions in an extraction region of said device to form an ion cloud, and (iii) an extraction voltage for causing ejection of the ion cloud from said extraction region in an extraction direction orthogonal to said longitudinal axis of said device; and a time-of-flight mass analyzer for performing mass analysis of ions ejected from said extraction region, and wherein, for each electrode section of a first segment of the pair of adjacent segments for which the interior surface is continuous, a respective distance from the longitudinal axis of the ion storage device to a nearest point to the longitudinal axis of the ion storage device along the interior surface of the electrode section is substantially equivalent to a same first distance, wherein, for each electrode section of a second segment of the pair of adjacent segments for which the interior surface is continuous, a respective distance from the longitudinal axis of the ion storage device to a nearest point to the longitudinal axis of the ion storage device along the interior surface of the electrode section is substantially equivalent to a same second distance, and wherein the first distance for the first segment is different than the second distance for the second segment.

39. A spectrometer as claimed in claim 38 wherein said extraction region comprises a trapping volume of a single segment of the device.

40. A spectrometer as claimed in claim 38 further comprising an ion cloud treatment mechanism for reducing the physical size of, and/or velocity spread of ions in said ion cloud in directions transverse to said longitudinal axis before said extraction voltage is applied.

41. A spectrometer as claimed in claim 40 wherein said ion cloud treatment mechanism is effective to encourage said ion cloud to form on said longitudinal axis before said extraction voltage is applied.

42. A spectrometer as claimed in claim 40 wherein said extraction region comprises a trapping volume of one or more extraction segments of the device and said ion cloud treatment mechanism is arranged to cause said voltage supply to increase a trapping voltage applied to said extraction region.

43. A spectrometer as claimed in claim 42 wherein said increase comprises a succession of stepped abrupt increases.

44. A spectrometer as claimed in claim 40 wherein said extraction region comprises a trapping volume of one or more extraction segments of the device and said ion cloud treatment mechanism is arranged to cause said voltage supply to terminate a trapping voltage applied to said one or more extraction segment and to impose a delay between termination of the trapping voltage and application of the extraction voltage.

45. A spectrometer as claimed in claim 44 wherein said voltage supply applies an intermediate voltage to said one or more extraction segment during said delay.

46. A spectrometer as claimed in claim 40 wherein said trapping voltage is also effective to compress said ion cloud axially within said extraction region.

47. A spectrometer as claimed in claim 39 wherein the single segment of said extraction region is an extraction segment of the device, and wherein said extraction segment includes a first respective electrode section which, when supplied with a first level of said trapping voltage enables ions to form a substantially one-dimensional axially extending ion cloud within the extraction region and a second respective electrode section which, when supplied with a second level of said trapping voltage is effective to transform said substantially one-dimensional axially extending cloud to form a substantially two-dimensional ion cloud in a central plane orthogonal to said extraction direction.

48. A spectrometer as claimed in claim 47 wherein said substantially two-dimensional ion cloud is a toroidally shaped ion cloud.

49. A spectrometer as claimed in claim 47 comprising an ion cloud treatment mechanism for reducing the physical size of, and/or velocity spread of ions in the ion cloud in directions transverse to said longitudinal axis before and/or after said second level of said trapping voltage is applied.

50. A spectrometer as claimed in claim 38 wherein said device has an entrance end and an exit end, an ion detection mechanism located at said exit end, and said voltage supply is arranged to allow sample ions to pass through said device from said entrance end to said exit end for detection by said ion detection mechanism and subsequently to trap ions received within the device from said ion source and prevent further ions from entering the device after a time interval determined by an ion current detected by said ion detection mechanism.

51. A spectrometer as claimed in claim 38 wherein said trapping voltage is effective to trap sample ions in an ion storage region of the device located between an entrance end of the device and an axially-extending region of the device and subsequently to cause ions to pass from said ion storage region into another region of the device whilst simultaneously trapping further sample ions in the ion storage region.

52. A spectrometer as claimed in claim 51 wherein voltage supplied to said device by said voltage supply causes ions to undergo fragmentation and/or isolation in a region or regions outside said ion storage region whilst simultaneously trapping further sample ions in said ion storage region.

53. A spectrometer as claimed in claim 51 wherein said ion storage region comprises a trapping volume of a single segment of the device.

54. A spectrometer as claimed in claim 51 wherein said another region is said axially extending region.

55. A spectrometer as claimed in claim 38 wherein said trapping voltage is effective to trap ions in a fragmentation region of the device, and said voltage supply is arranged to supply fragmentation voltage to the device to cause fragmentation of ions trapped in the fragmentation region.

56. A spectrometer as claimed in claim 55 wherein said fragmentation voltage comprises dipole excitation voltage effective to cause fragmentation of ions in a selected range of mass-to-charge ratio.

57. A spectrometer as claimed in claim 56 wherein said dipole excitation voltage is effective to cause said fragmentation of ions by Collision Induced Dissociation (CID).

58. A spectrometer as claimed in claim 57 wherein said dipole excitation voltage is effective to cause CID by accelerating ions from each of one or more of the plurality of segments of said device into one of more of the segments of the device adjacent to the segment at lower axial potential.

59. A spectrometer as claimed in claim 55 wherein said fragmentation region is separate from said extraction region and said fragmentation voltage creates a quadrupole trapping field substantially within an entire volume of said fragmentation region.

60. A spectrometer as claimed in claim 55 wherein said voltage supply is arranged to supply isolation voltage to the device to isolate for fragmentation precursor ions in a selected range of mass-to-charge ratio.

61. A spectrometer as claimed in claim 60 wherein said isolation voltage is broadband isolation voltage effective to isolate precursor ions in said selected range of mass-to-charge ratio.

62. A spectrometer as claimed in claim 60 wherein said isolation voltage is effective to perform forward and reverse frequency scanning to eject ions to either side of said selected range of mass-to-charge ratio.

63. A spectrometer as claimed in claim 60 wherein said isolation voltage is applied to one or more of the segments of said device that are separate from said extraction region and creates a quadrupole trapping field along and substantially within the entire volume of the one or more segments to which it is applied.

64. A spectrometer as claimed in claim 51 wherein said voltage supply is arranged to cause mass to charge ratio filtering of ions prior to fragmentation and/or isolation of the ions.

65. A spectrometer as claimed in claim 51 wherein said voltage supply is arranged to cause filtering of ions in a first filtering region of the device prior to their fragmentation and to cause further filtering of ions in a second filtering region of the device after their fragmentation.

66. A spectrometer as claimed in claim 65 wherein said first filtering region and said second filtering region are each defined by a single segment of the device.

67. A spectrometer as claimed in claim 66 wherein said fragmentation voltage is effective to cause further fragmentation of ions before they become trapped in said axially extending region.

68. A spectrometer as claimed in claim 65 wherein filtering and fragmentation are carried out in the first filtering region simultaneously with filtering and fragmentation being carried out in the second filtering region of the device.

69. A spectrometer as claimed in claim 55 wherein said fragmentation voltage is effective to cause repeated fragmentation of ions to provide a $MS^n$ capability.

70. A mass spectrometer according to claim 38 wherein said segmented linear multipole ion storage device is a segmented linear quadrupole ion storage device.

71. A mass spectrometer as claimed in claim 70 wherein the respective electrode sections of at least one of the segments of the device are flat plate electrodes.

72. A segmented linear ion storage device for use in a time-of-flight mass spectrometer as claimed in claim 38.

73. A time-of-flight mass spectrometer comprising:

an ion source for supplying sample ions, a segmented linear multiple ion storage device having a longitudinal axis for receiving sample ions supplied by the ion source, wherein each segment of the ion storage device comprises a plurality of electrodes, adjacent segments of the ion storage device having different radial dimensions, and the radial dimension of each segment defines the radial positions of the electrodes of the segment with respect to the longitudinal axis;

a voltage supply which supplies to the device an RF multipole trapping voltage to create a multipole trapping field which is substantially uniform along and between adjacent segments of said device, to enable ions to pass between adjacent segments without substantial loss of ions, a DC trapping voltage to segments of the ion storage device to cause sample ions, or ions derived from sample ions to move between different axially-extending regions of the device where ions selectively undergo MS processing, to cause processed ions to become trapped in the trapping volume of an extraction segment of the device, and an extraction voltage to the extraction segment to eject trapped ions in an extraction direction, orthogonal to said longitudinal axis of the device, and a time-of-flight analyzer which performs mass analysis of ions ejected from the extraction segment.

74. A spectrometer as claimed in claim 73 wherein said MS processing is selected from fragmentation, isolation, filtering and storage.

75. A time-of-flight mass spectrometer as claimed in claim 74 wherein different MS processes are simultaneously carried out in different axially-extending regions of the device.

76. A time-of-flight mass spectrometer as claimed in claim 75 wherein each axially extending region comprises a single segment or a group of two or more mutually adjacent segments.

77. A time-of-flight mass spectrometer comprising:

an ion source for supplying sample ions;

a segmented linear ion storage device for receiving the sample ions;

a voltage supply; and a time-of-flight mass analyzer, and wherein the segmented linear ion storage device comprises:

at least a pair of adjacent segments extending along a longitudinal axis of the ion storage device, and an axially-extending region comprising a trapping volume of a group of two or more mutually adjacent segments of the device, and an extraction region that is shorter than the axially-extending region, wherein the time-of-flight mass analyzer operates to perform mass analysis of ions ejected from the extraction region wherein the voltage supply operates to supply to the device:

a trapping voltage including an RF trapping voltage, and an extraction voltage, and wherein the trapping voltage, with the assistance of cooling gas, is effective to trap the sample ions or ions derived from said sample ions in the trapping volume of the axially-extending region and to cause the trapped ions subsequently to become trapped in the extraction region to form an ion cloud, wherein the RF trapping voltage creates a quadrupole trapping field that is substantially uniform along and between the pair of adjacent segments to enable ions to pass between the pair of adjacent segments without substantial loss of ions, and wherein the extraction voltage is effective to cause ejection of the ion cloud from said extraction region in an extraction direction orthogonal to said longitudinal axis of the ion storage device, wherein each segment comprises a respective plurality of electrode sections that each have an interior surface, wherein, for each electrode section of a first segment of the pair of adjacent segments, a respective distance from the longitudinal axis of the ion storage device to a nearest point to the longitudinal axis of the ion storage device along the interior surface of the electrode section is substantially equivalent to a same first distance, wherein, for each electrode section of a second segment of the pair of adjacent segments, a respective distance from the longitudinal axis of the ion storage device to a nearest point to the longitudinal axis of the ion storage device along the interior surface of the electrode section is substantially equivalent to a same second distance, and wherein the first distance for the first segment is different than the second distance for the second segment.

* * * * *